US008870247B2

(12) United States Patent
Yamagata et al.

(10) Patent No.: US 8,870,247 B2
(45) Date of Patent: Oct. 28, 2014

(54) DOOR LOCKING APPARATUS

(75) Inventors: Mikio Yamagata, Hiroshima (JP); Nobuya Akagi, Hiroshima (JP)

(73) Assignee: U-Shin Ltd., Tokyo (JP)

( * ) Notice: Subject to any disclaimer, the term of this patent is extended or adjusted under 35 U.S.C. 154(b) by 451 days.

(21) Appl. No.: 13/275,825

(22) Filed: Oct. 18, 2011

(65) Prior Publication Data

US 2012/0096905 A1 Apr. 26, 2012

(30) Foreign Application Priority Data

Oct. 20, 2010 (JP) ..... 2010-235849

(51) Int. Cl.

| | |
|---|---|
| ***E05C 3/06*** | (2006.01) |
| ***E05B 81/16*** | (2014.01) |
| ***E05B 81/36*** | (2014.01) |
| ***E05B 85/02*** | (2014.01) |
| ***E05B 81/06*** | (2014.01) |
| ***E05B 77/34*** | (2014.01) |
| *E05C 3/16* | (2006.01) |
| *E05B 63/00* | (2006.01) |

(52) U.S. Cl.

CPC ..... *E05B 85/02* (2013.01); *E05B 81/16* (2013.01); *E05B 63/0065* (2013.01); *E05B 81/36* (2013.01); *E05B 81/06* (2013.01); *E05B 77/34* (2013.01); *Y10S 292/23* (2013.01)

USPC ..... 292/201; 292/216; 292/DIG. 23

(58) Field of Classification Search

USPC ..... 292/201, 216, DIG. 23

See application file for complete search history.

(56) References Cited

U.S. PATENT DOCUMENTS

| | | | | | |
|---|---|---|---|---|---|
| 3,566,703 | A | * | 3/1971 | Van Noord | 74/50 |
| 4,518,182 | A | * | 5/1985 | Cousin et al. | 292/201 |
| 4,520,914 | A | * | 6/1985 | Kagiyama et al. | 192/71 |
| 4,898,414 | A | * | 2/1990 | Yamada | 292/337 |
| 4,904,006 | A | * | 2/1990 | Hayakawa et al. | 292/336.3 |
| 4,905,532 | A | * | 3/1990 | Fukumoto et al. | 74/425 |
| 4,932,690 | A | * | 6/1990 | Kleefeldt et al. | 292/337 |
| 4,948,183 | A | * | 8/1990 | Yamada | 292/199 |
| 4,978,154 | A | * | 12/1990 | Kleefeldt et al. | 292/201 |
| 5,066,054 | A | * | 11/1991 | Ingenhoven | 292/201 |
| 5,072,975 | A | * | 12/1991 | Hamada et al. | 292/201 |
| 5,078,436 | A | * | 1/1992 | Kleefeldt et al. | 292/201 |
| 5,236,234 | A | * | 8/1993 | Norman | 292/201 |

(Continued)

FOREIGN PATENT DOCUMENTS

| | | | | |
|---|---|---|---|---|
| DE | 3207880 A1 | * | 9/1983 | E05B 65/20 |
| EP | 0 894 924 | | 2/1999 | |

(Continued)

*Primary Examiner* — Carlos Lugo

(74) *Attorney, Agent, or Firm* — Wenderoth, Lind & Ponack, LLP

(57) ABSTRACT

A door locking apparatus that can be used for both manual operating specifications and automatic operating specifications and that is capable of miniaturization and weight reduction in a use for the manual operating specifications includes a latch mechanism, a door opening mechanism and a manual locking mechanism wherein, a first housing (10) in which the door opening mechanism and the manual locking mechanism are disposed and a second housing (42) in which an automatic locking mechanism that moves the door opening mechanism to the unlocking position or the locking position based on an input of an electric signal is disposed are provided, and a second housing attaching portion (23) to which the second housing can be attached is provided on the first housing.

5 Claims, 16 Drawing Sheets

(56) References Cited

U.S. PATENT DOCUMENTS

| | | | | | |
|---|---|---|---|---|---|
| 5,350,206 | A | * | 9/1994 | Akahori et al. | 292/336.3 |
| 5,360,351 | A | * | 11/1994 | Periou et al. | 439/357 |
| 5,441,315 | A | * | 8/1995 | Kleefeldt et al. | 292/201 |
| 5,529,355 | A | * | 6/1996 | Fukumoto | 292/337 |
| 5,564,308 | A | * | 10/1996 | Hoshikawa et al. | 74/89.14 |
| 5,713,613 | A | * | 2/1998 | Honma et al. | 292/201 |
| 5,715,713 | A | * | 2/1998 | Aubry et al. | 70/277 |
| 5,746,076 | A | * | 5/1998 | Inoue | 70/277 |
| 5,829,799 | A | * | 11/1998 | Yamagishi et al. | 292/201 |
| 5,855,130 | A | * | 1/1999 | Rorabacher et al. | 70/277 |
| 6,109,674 | A | * | 8/2000 | Bartel et al. | 292/337 |
| 6,371,537 | B1 | * | 4/2002 | Vige et al. | 292/201 |
| 6,634,682 | B2 | * | 10/2003 | Fukunaga et al. | 292/216 |
| 7,500,700 | B2 | * | 3/2009 | Kunst | 292/201 |
| 7,621,571 | B2 | * | 11/2009 | Umino | 292/216 |

FOREIGN PATENT DOCUMENTS

| | | |
|---|---|---|
| JP | 59-118970 | 7/1984 |
| JP | 4-229010 | 8/1992 |
| JP | 2001-262902 | 9/2001 |
| JP | 2007-500806 | 1/2007 |
| JP | 2010-144455 | 7/2010 |
| WO | 2005/012676 | 2/2005 |

* cited by examiner (B)

(A)

(B)

(A)

DOOR LOCKING APPARATUS

BACKGROUND OF THE INVENTION

1. Field of the Invention

The present invention relates to a door locking apparatus that is mounted on a door of a vehicle.

2. Description of Related Art

This kind of door locking apparatus includes a latch mechanism, and the latch mechanism includes a fork that retains a striker provided on a vehicle side and a claw that engages with the fork to keep the fork latching the striker. The door locking apparatus also includes a door opening mechanism that can switch between an unlocking position where the claw can be engaged and a locking position where the claw cannot be engaged. The door locking apparatus also includes a locking mechanism that moves the door opening mechanism to the unlocking position or the locking position. The locking mechanism includes a manual locking mechanism and an automatic locking mechanism. The manual locking mechanism is operated by a manipulation of a locking knob disposed on the inner side of the vehicle or a key cylinder disposed on the cuter side of the vehicle. The automatic locking mechanism is operated by a manipulation of a locking switch placed in the vehicle or a remote controller.

For example, Japanese Unexamined Patent Publication No. 2001-262902 discloses, a door locking apparatus in which a waterproof property and a burglar-proof property are improved by providing components respectively constituting the latch mechanism, the door opening mechanism, the manual locking mechanism, and the automatic locking mechanism in the closed housing. A locking state detector that detects whether the door opening mechanism is in the locking state or an unlocking state is also accommodated in the housing.

On the other hand, depending on the vehicle, only the latch mechanism, the door opening mechanism, and the manual locking mechanism are mounted on the door locking apparatus (manual operating specifications). In this case, although the same housing as one of the automatic operating specifications on which the automatic locking mechanism is mounted is used, the automatic locking mechanism is not mounted. Therefore, cost increase associated with production of plural kinds of housings is prevented.

However, a space in which the automatic locking mechanism is mounted exists in the housing of the door locking apparatus that is used in the manual operating specifications. Compared with the door locking apparatus that is produced only for the purpose the manual operating specifications, disadvantageously the door locking apparatus has a large housing and uselessly occupies the space. Disadvantageously, a weight is also increased because of the large housing.

SUMMARY OF THE INVENTION

An object of the invention is to provide a door locking apparatus, which can be used in both manual operating specifications and automatic operating specifications and miniaturization, and in which a weight reduction can be implemented in a use for the manual operating specifications.

To achieve the above object, in accordance with one aspect of the present invention, it is provided a door locking apparatus with an automatic operating specifications including: a latch mechanism that can latch and release a striker; a door opening mechanism that can switch between an unlocking position where the striker latched by the latch mechanism can be released and a locking position where the striker latched by the latch mechanism cannot be released, and that is operated by a manipulation of an inner handle for opening a door or a outer handle for opening the door; a manual locking mechanism that moves the door opening mechanism to the unlocking position or the locking position by a manipulation of a locking knob for use from inside a vehicle or a key cylinder for use from outside the vehicle; and an automatic locking mechanism that moves the door opening mechanism to the unlocking position or the locking position in response to an input of an electric signal, wherein a first housing in which at least the door opening mechanism and the manual locking mechanism are disposed and a second housing in which the automatic locking mechanism is disposed are provided, a second housing attaching portion to which the second housing is attached is provided on the outside of the first housing, and first and second communication holes through which a rotational driving torque of the automatic locking mechanism is transmitted to the door opening mechanism are made in the first and second housings so as to be communicated with each other.

In accordance with another aspect of the present invention, it is provided a door locking apparatus with an automatic operating specifications including: a latch mechanism that can latch and release a striker; a door opening mechanism that can switch between an unlocking position where the striker latched by the latch mechanism can be released and a locking position where the striker latched by the latch mechanism cannot be released, and is operated by a manipulation of an inner handle or an outer handle for opening a door; and a manual locking mechanism that moves the door opening mechanism to the unlocking position or the locking position by a manipulation of a locking knob for use from inside a vehicle or a key cylinder for use from outside the vehicle, wherein a first housing in which at least the door opening mechanism and the manual locking mechanism are disposed is provided, and a second housing attaching portion to which a second housing can be attached is provided in the first housing, an automatic locking mechanism that moves the door opening mechanism to the unlocking position or the locking position based on an input of an electric signal being disposed in the second housing.

In the door locking apparatus, the door opening mechanism and the manual locking mechanism are accommodated in the first housing, and the automatic locking mechanism is accommodated in the second housing. In a use with the automatic operating specifications, the door locking apparatus is configured such that the second housing in which the automatic locking mechanism is mounted is attached to the first housing. In a use with the manual operating specifications, the door locking apparatus includes only the first housing without attaching the second housing.

In the door locking apparatus with automatic operating specifications, although the automatic locking mechanism is disposed in the second housing that is different from the first housing in which the door opening mechanism is disposed, a rotational driving torque of the automatic locking mechanism can be transmitted to the door opening mechanism through the communication hole of each housing. In the door locking apparatus, the door opening mechanism and the manual locking mechanism are accommodated in the closed first housing, and the automatic locking mechanism is accommodated in the closed second housing. Therefore, a waterproof property and a burglar-proof property can be maintained.

In the door locking apparatus with manual operating specifications, the door opening mechanism and the manual locking mechanism are disposed in the first housing, so that a driving force of the manual locking mechanism can securely be transmitted to the door opening mechanism. Because necessity to provide a space in which the automatic locking mechanism is accommodated is eliminated in the first housing, the miniaturization and the weight reduction can be implemented. In the door locking apparatus, the door opening mechanism and the manual locking mechanism are accommodated in the closed first housing, so that the waterproof property and the burglar-proof property can be maintained.

In the door locking apparatus with automatic operating specifications, a switching lever constituting the manual locking mechanism is turnably disposed in the first communication hole of the first housing, an output shaft that outputs the rotational driving torque of the automatic locking mechanism is disposed in the second communication hole of the second housing, the switching lever and the output shaft are coupled through the first and second communication holes so as not to be able to relatively turn, and through the manual locking mechanism, the automatic locking mechanism moves the door opening mechanism to the unlocking position and the locking position. Therefore, the automatic locking mechanism accommodated in the second housing can easily be coupled. Further, the manual locking mechanism is also used to transmit the rotational driving torque of the automatic locking mechanism to the door opening mechanism. Therefore, a configuration of components disposed in the first housing can be simplified.

Preferably, in the first housing, a locking state detector that detects an unlocking state or a locking state of the door opening mechanism to output the detection state as an electric signal and a connector that externally outputs the electric signal from the locking state detector are disposed, and a connector placing portion of the first housing, in which the connector is disposed, is provided so as to be located inner than the second housing attaching portion, and a terminal insertion hole through which a connection terminal is disposed is made in the connector placing portion in order to supply an electric power to the automatic locking mechanism. Therefore, in both case of the manual operating specifications and the automatic operating specifications, the same connector can be used, and work for connecting an external connector can be performed at a same point.

Preferably an annular sealing member is disposed between the first and second housings so as to surround the first and second communication holes. Therefore, because water immersion from the communication hole can be prevented, the waterproof property can be ensured.

In the door locking apparatus with manual operating specifications, a communication hole through which a rotational driving torque of the automatic locking mechanism disposed in the second housing is transmitted to the door opening mechanism is preferably closed in the first housing to which the second housing is not attached. Therefore, the water immersion into the first housing can securely be prevented.

In the door locking apparatus of the present invention, In a use with the automatic operating specifications, the door opening mechanism and the manual locking mechanism are accommodated in the closed first housing, and the automatic locking mechanism is accommodated in the closed second housing. Therefore, the waterproof property and the burglar-proof property can be maintained. In a use with the manual operating specifications, because the necessity to provide the space in which the automatic locking mechanism is accommodated is eliminated in the first housing, the miniaturization and the weight reduction can be implemented. Additionally, the waterproof property and the burglar-proof property can be maintained.

DETAILED DESCRIPTION OF PREFERRED EMBODIMENTS

Hereinafter, an embodiment of the invention will be described with reference to the drawings.

Figure 1:
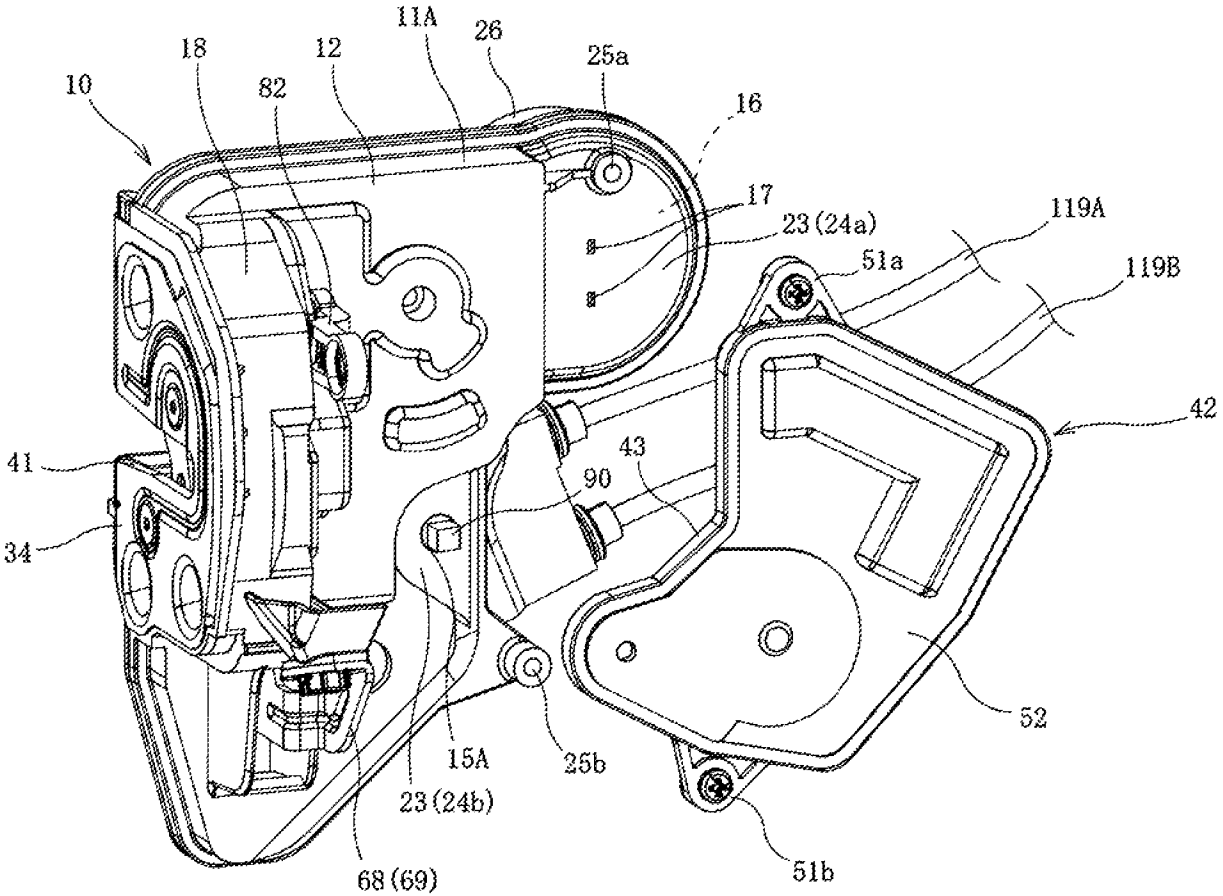
FIG. 1 is an exploded perspective view illustrating a door locking apparatus with automatic operating specifications according to an embodiment of the invention.
Figure 2:
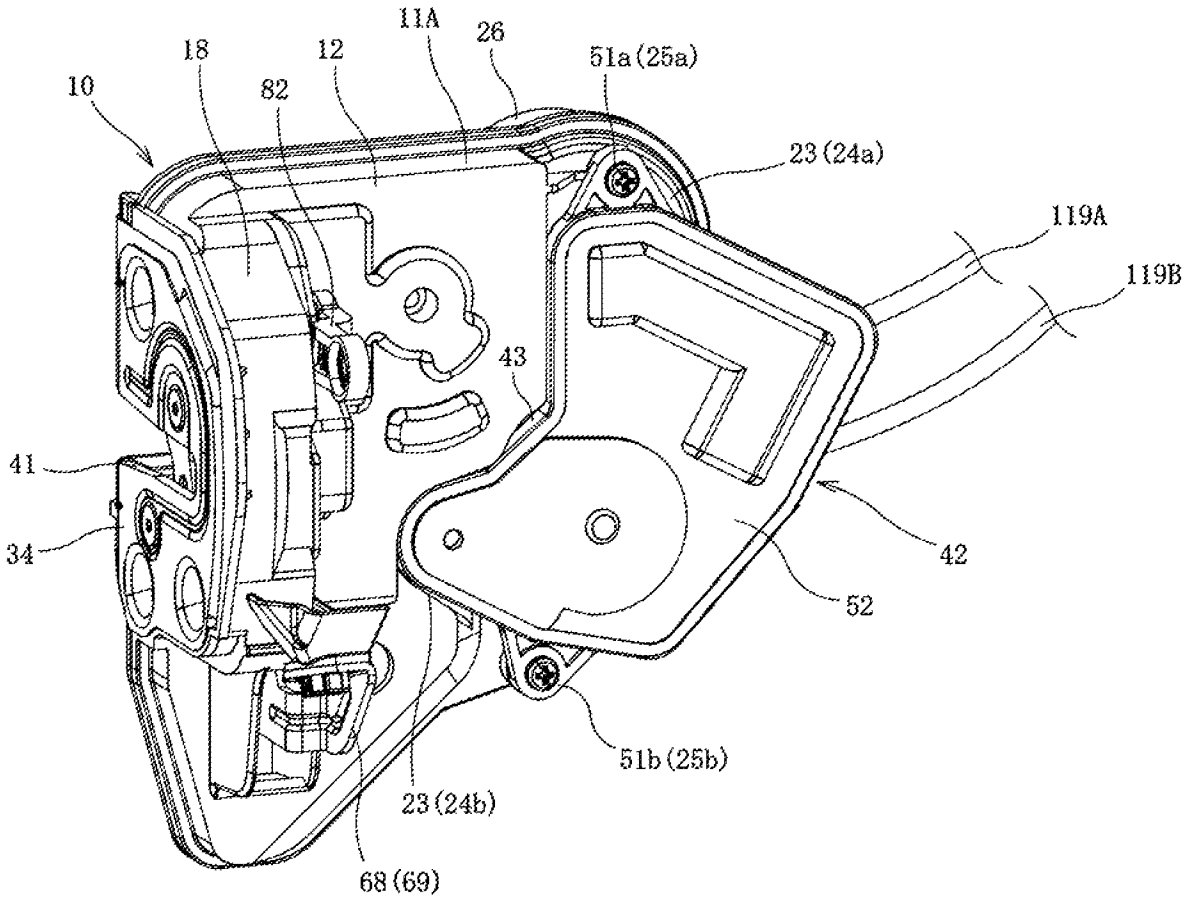
FIG. 2 is a perspective view illustrating an assembled state of the door locking apparatus with automatic operating specifications.

FIGS. 1 and 2 illustrate a door locking apparatus according to an embodiment of the present invention. The door locking apparatus of the embodiment is mounted on a door of a vehicle, and the door locking apparatus includes a latch mechanism that can latch and release a striker 1 provided on a vehicle body, a door opening mechanism that releases the striker 1 latched by the latch mechanism, and a manual locking mechanism and an automatic locking mechanism, which move the door opening mechanism to an unlocking position or a locking position.

Figure 3:
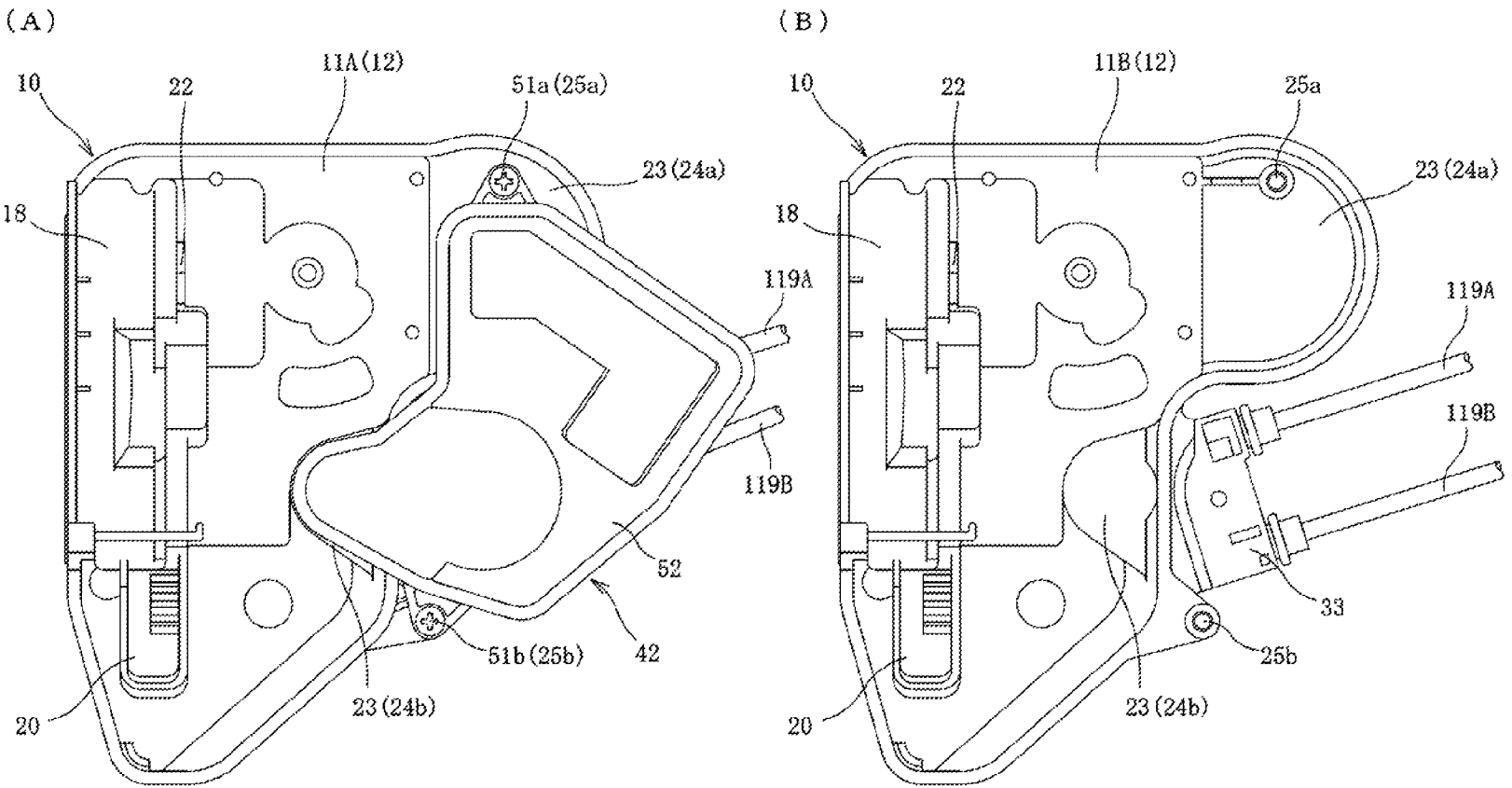
FIG. 3 shows a rear view illustrating the assembled state of the door locking apparatus with automatic operating specifications in (A) and a rear view illustrating an assembled state of a door locking apparatus with manual operating specifications in (B)

In the embodiment, the latch mechanism, the door opening mechanism, and the manual locking mechanism are accommodated in a first housing 10, the automatic locking mechanism is accommodated in a second housing 42, and the second housing 42 can optionally be attached to the first housing 10. Therefore, the door locking apparatus is configured to be able to choose an automatic operating specifications including the first housing 10 and the second housing 42 as illustrated in FIG. 3(A) or manual operating specifications including only the first housing 10 as illustrated in FIG. 3(B).

Figure 4:
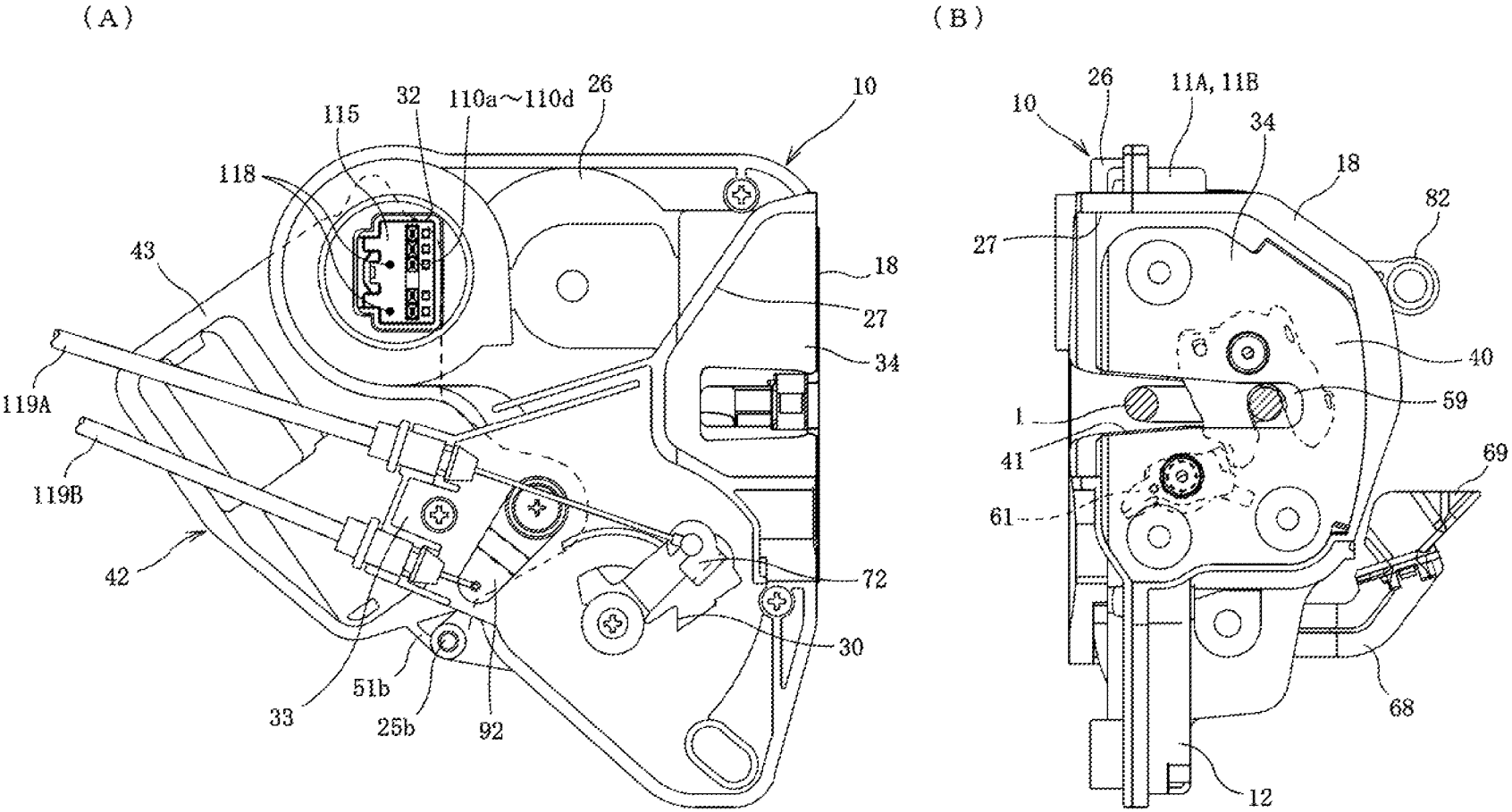
FIG. 4 shows the door locking apparatus with automatic operating specifications in a front view of in (A) and in a side view of (A) in (B)

As illustrated in FIGS. 1, 4(A), and 4(B), the first housing 10 includes two kinds of first cases 11A and 119 in which the door opening mechanism and the manual locking mechanism are accommodated, a second case 26 that closes an opening of the first cases 11A and 11B, and a third case 34 in which the latch mechanism is accommodated. The first case 11A has automatic operating specifications, and the first case 11B has manual operating specifications.

Figure 5:
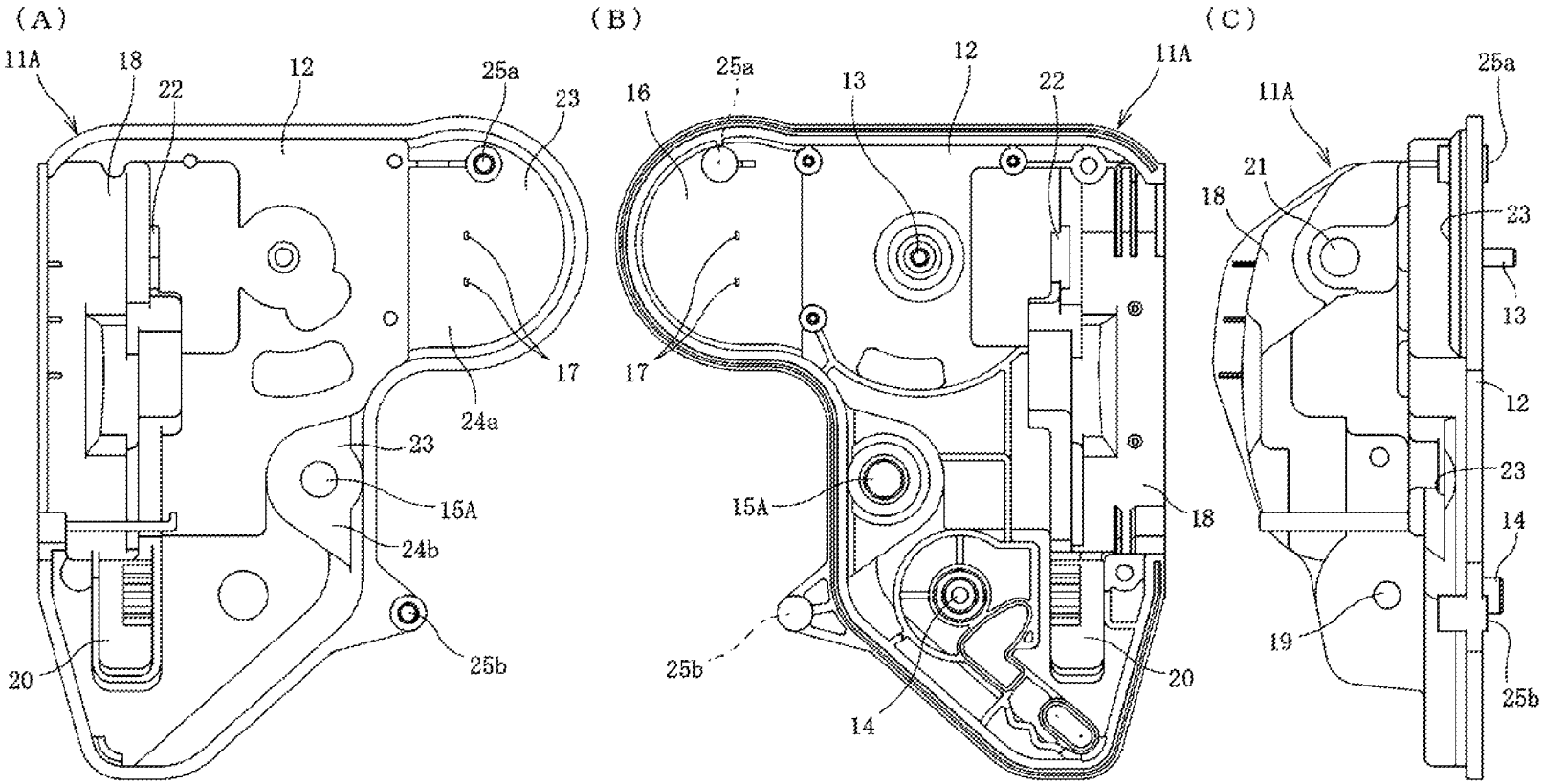
FIG. 5 shows a first case of a first housing for automatic operating specifications in a front view illustrating a side of an outer surface in (A), in a rear view illustrating a side of an inner surface in (B) and in a side view in (C)

As illustrated in FIGS. 4(B) and 5(C), first case 11A with the automatic operating specifications has an L-shape in plan view, and includes a first placing portion 12 in which the door opening mechanism and the manual locking mechanism are disposed and a second placing portion 18 in which the third case 34 with the latch mechanism disposed in is disposed.

As illustrated in FIG. 5(B), an attaching shaft portion 13 to which a locking plate 74 and a key switch lever 78 are turnably attached is provided in a substantially central upper portion of the first placing portion 12. An attaching shaft portion 14 to which an inner lever 71 is turnably attached is provided in a substantially central lower portion of the first placing portion 12. A lever attaching portion 15A is provided on the left side of the attaching shaft portion 14 in order to turnably dispose a switching lever 83A. The lever attaching portion 15A with automatic operating specifications is a first Communication hole including a through-hole. A connector placing portion 16 in which a connector 115 is disposed is provided on the left side of the attaching shaft portion 13. The connector placing portion 16 is projected so as to form a substantially semi-circular shape. A pair of terminal insertion holes 17 is made in the center of the connector placing portion 16 such that a connection terminal 118 is disposed through the terminal insertion holes 17 in order to supply an electric power to the automatic locking mechanism.

An opening of the third case 34 in which the latch mechanism is disposed is covered with the second placing portion 18. As illustrated in FIG. 5(C), an attaching hole 19 thorough which an outer lever 68 is turnably attached is made in a lower part of the second placing portion 18. On the lateral side of the attaching hole 19, a lever insertion hole 20 is made so as to be located at a boundary with the first placing portion 12. The outer lever 68 is inserted through the lever insertion hole 20 and disposed in the first placing portion 12. An attaching hole 21 through which a key lever 80 is turnably attached is made in an upper part of the second placing portion 18. In a lateral side of the attaching hole 21, a lever insertion hole 22 is made so as to be located at the boundary with the first placing portion 12. The key lever 80 is inserted through the lever insertion hole 22 and disposed in the first placing portion 12.

As illustrated in FIGS. 5(A) and 5(C), in the first case 11A of the embodiment, a second housing attaching portion 23 is provided in order to attach the second housing 42 on the outer surface. The second housing attaching portion 23 consists of the outer surface of the connector placing portion 16 and the outer surface of the lever attaching portion 15A. The outer surface of the connector placing portion 16 and the outer surface of the lever attaching portion 15A constitute flat surface portions 24*a* and 24*b* each of which is recessed in a stepwise manner toward the inner side. Screw tightening portions 25*a* and 25*b* are provided in the upper part of the flat surface portion 24*a* and the lower part of the flat surface portion 24*b*.

Figure 6:
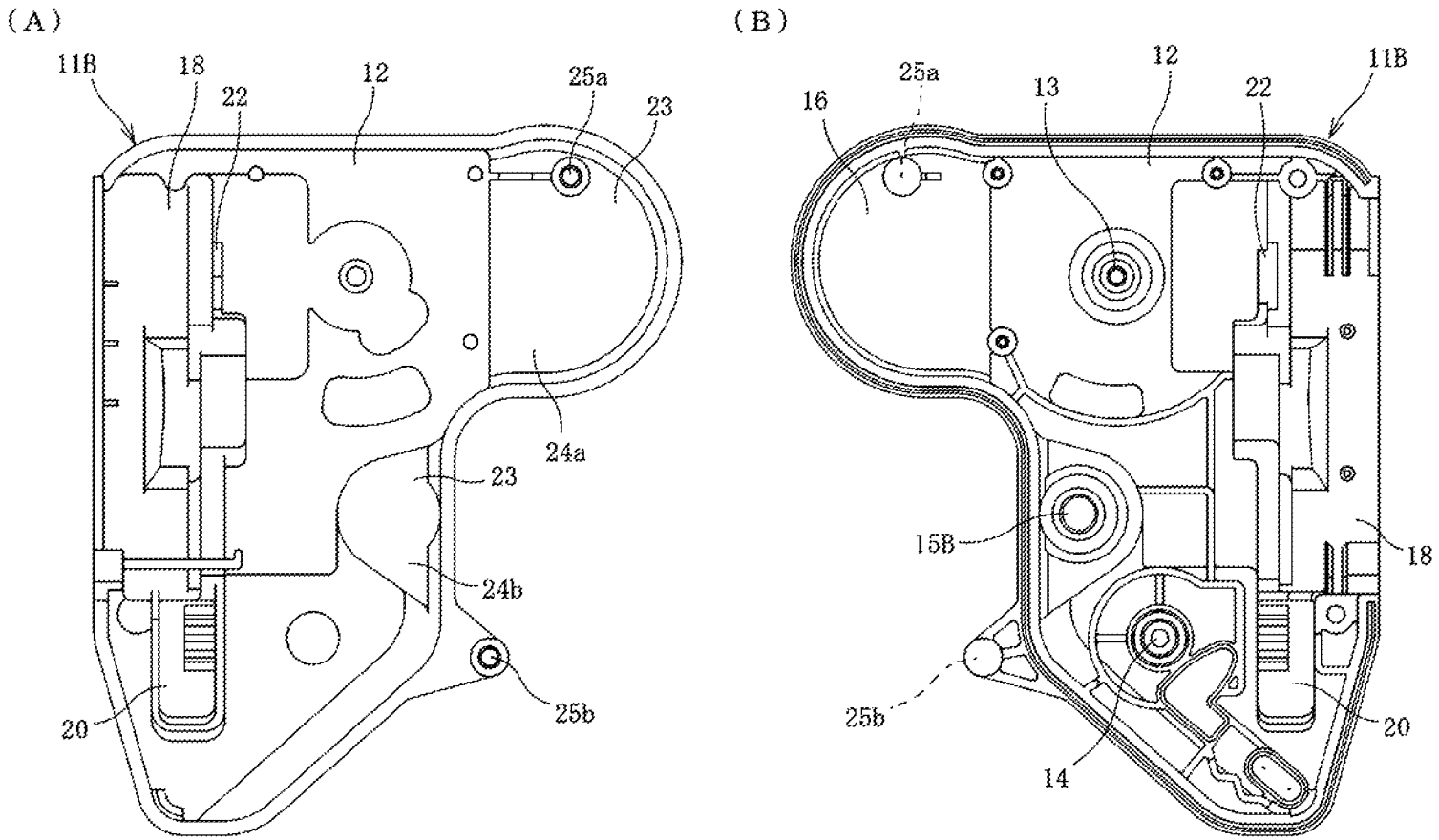
FIG. 6(A) shows a first case of first housing for manual operating specifications, in a front view illustrating a side of an outer surface in (A) and in a rear view illustrating a side of an inner surface in (B)

As illustrated in FIGS. 6(A) and 6(B), the first case 11B with manual operating specifications differs from the first case 11A in that a lever attaching portion 15B and the terminal insertion holes 17 of the connector placing portion 16 are closed. Specifically, the lever attaching portion 15B of the first case 11B consists of a projection to which a switching lever 83B is turnably attached. In the connector placing portion 16 of the first case 11B, the terminal insertion hole 17 does not exist because of the closing.

In the first case 11B of the embodiment, the lever attaching portion 15B and the terminal insertion hole 17 are closed when resin molding. Each of molds that used to mold the first cases 11A and 11B has portions that form the lever attaching portions 15A and 15B and the connector placing portion 16 and that consist of separated bushings. The first case 11A having the holes and the first case 11B having no hole are selectively molded only by replacing the bushing. Alternatively, only the first case 11A having the hole is resin-molded, then the first case 11B may be configured by fitting a separated piece in the lever attaching portion 15B to close the hole and to form the projection and fitting in the terminal insertion hole 17 to close the hole.

Figure 7:
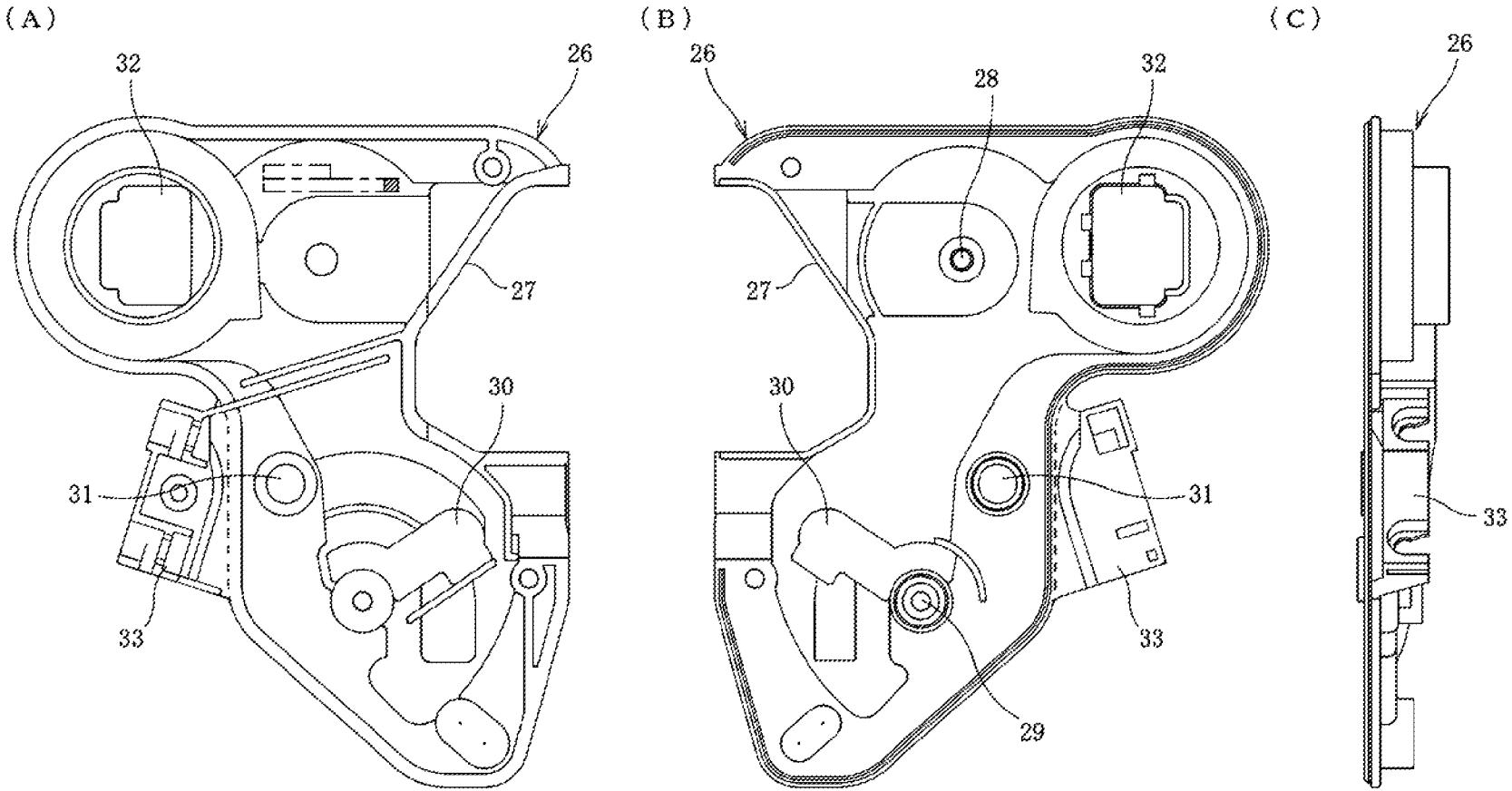
FIG. 7(A) shows a second case of a first housing in a front view illustrating a side of an outer surface in (A), in a rear view illustrating a side of an inner surface in (B) and in a side view in (C)

The second case 26 is commonly used for both automatic operating specifications and manual operating specifications, and formed into the same shape as the opening of the first placing portion 12 of the first cases 11A and 11B. The second case 26 is fixed to the first cases 11A and 11B by ultrasonic welding. As illustrated in FIGS. 7(A) to 7(C), a cutout 27 is provided in the second case 26 in order to expose the third case 34 attached to the second placing portion 18 of the first cases 11A and 11B. A bearing portion 28 is provided opposite the attaching shaft portion 13 of the locking plate 74, and a bearing portion 29 is provided opposite the attaching shaft portion 14 of the inner lever 71. Each of the bearing portions 28 and 29 consists of a closed recess. An insertion hole 30 is made around the bearing portion 29 in order to externally project an inner handle coupling portion 72 of the inner lever 71. A shaft support portion 31 is provided opposite the lever attaching portions 15A and 15B of the switching levers 83A and 83B. The shaft support portion 31 has a through-hole through which the shafts of the switching levers 83A and 83B are externally projected. A connector connecting port 32 is provided opposite the connector placing portion 16 in order to externally expose the connector 115. On the outer surface of the second case 26, a cable fixing portion 33 is provided so as to be located beside the bearing portion 29. The cable fixing portion 33 fixes a cable 119A connected to an inner handle for opening the door (not illustrated) and a cable 119B connected to a locking knob (not illustrated) for locking the door.

Figure 8:
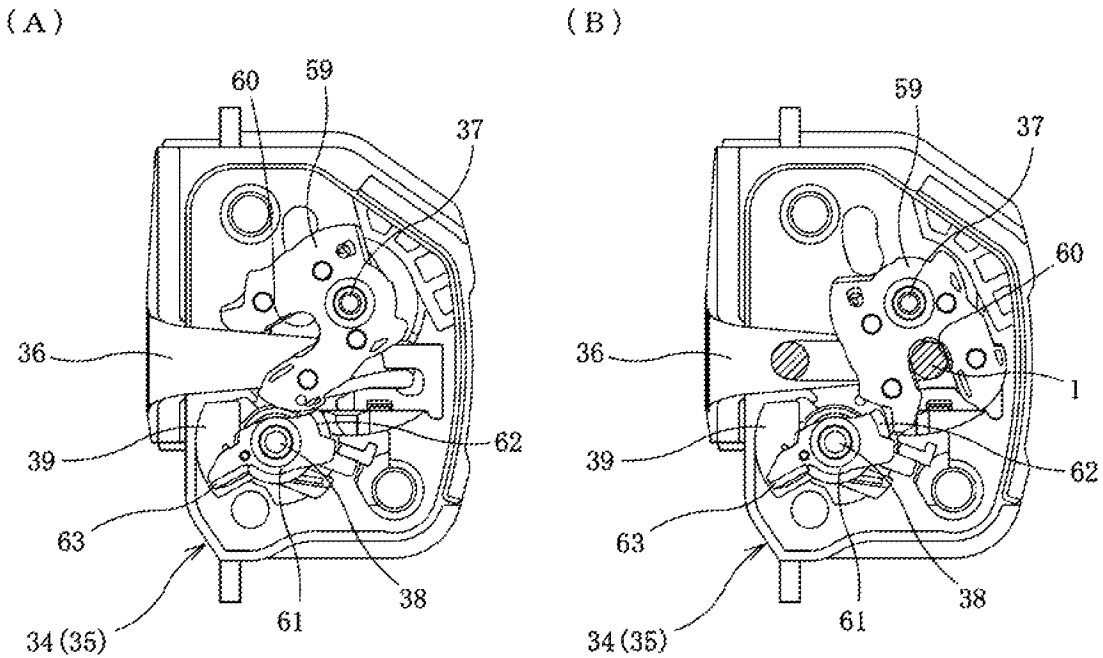
FIG. 8 shows a third case of the first housing of the door locking apparatus and a latch mechanism in a side view illustrating a door opened state in (A), and in a side view illustrating a door closed state in (B)

As illustrated in FIGS. 4(B), 8(A), and 8(B), the third case 34 is attached to the second placing portion 18 of the first cases 11A and 11B. The third case 34 includes a resin fence block 35 that is disposed on the side of the second placing portion 18 and a metallic safety plate 40 that is disposed on the outside. An insertion recess 36 that constitutes a space in which the striker 1 is inserted is provided in the fence block 35 so as to be recessed toward the second placing portion 18. An attaching portion 37 to which a fork 59 constituting the latch mechanism is turnably attached is provided above the insertion recess 36. An attaching portion 38 to which a claw 61 is turnably attached is provided below the insertion recess 36. An insertion hole 39 is made on the left side of the attaching portion 38, and a manipulation receiving portion 63 of the claw 61 is inserted in the insertion hole 39 and projected into the first placing portion 12. An insertion groove 41 is provided in the safety plate 40, and the striker 1 is inserted opposite the insertion recess 36.

As illustrated in FIGS. 1, 4(A), and 4(B), the second housing 42 includes a first case 43 in which the automatic locking mechanism is disposed and a second case 52 that closes the opening of the first case 43. The second housing 42 is attached to the second housing attaching portion 23 of the first housing 10 for automatic operating specifications in which the first case 11A is used, whereby the second housing 42 is fixed so as to be projected outward from the first housing 10. Therefore, the automatic locking function is added to the first housing 10 which performs only the manual locking function.

Figure 9:
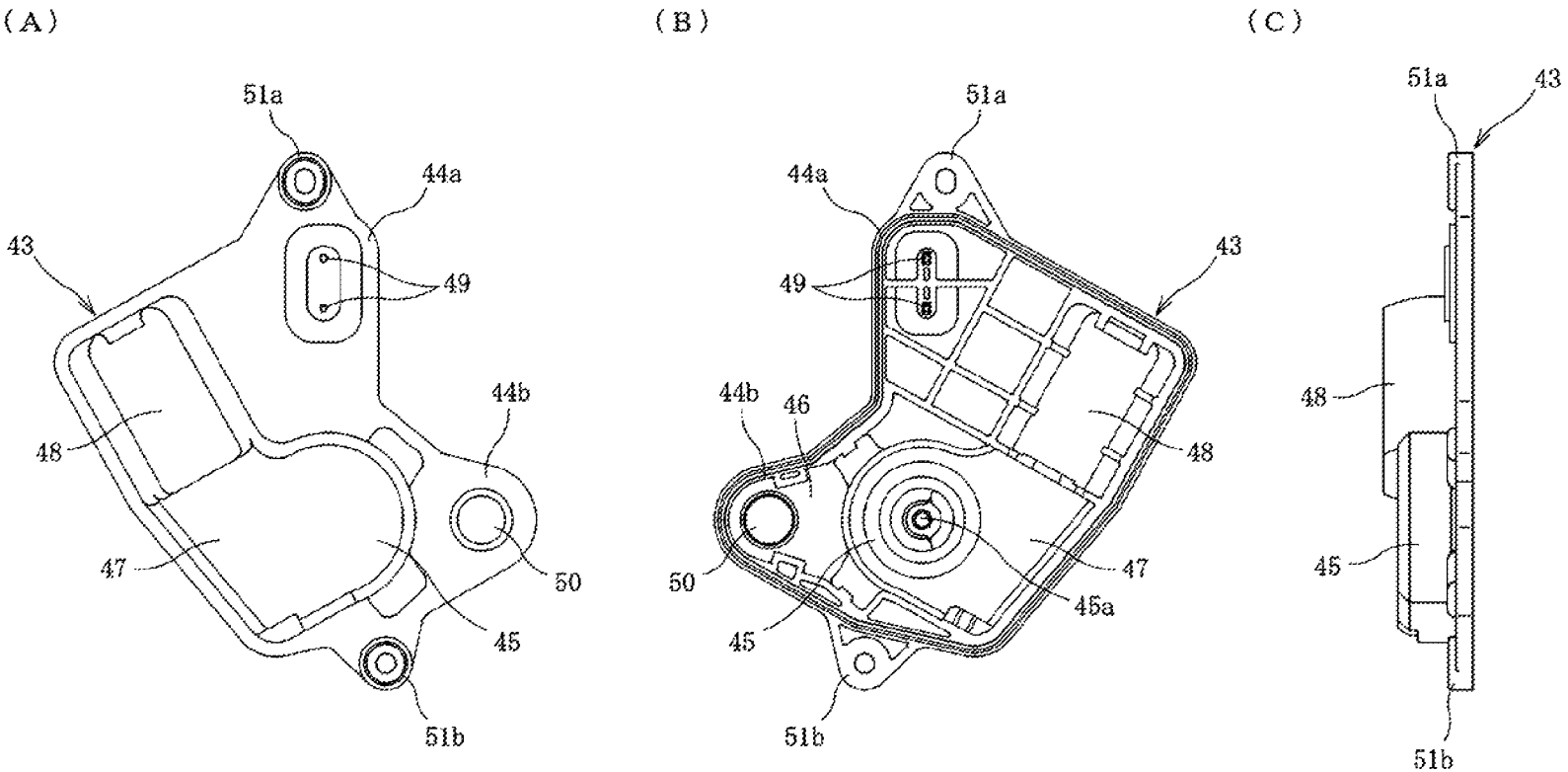
FIG. 9 shows a first case of a second housing in a front view illustrating a side, of an outer surface in (A), in a rear view illustrating a side of an inner surface in (B) and in a side view of the first case.

The first case 43 is disposed so as to be located on the side of the first housing 10. As illustrated in FIGS. 9(A) to 9(C), the first case 43 has a substantial B-shape in which projections 44*a* and 44*b* extending onto the flat surface portions 24*a* and 24*b* of the first case 11A from one side of the rectangular main body are provided. A cam member placing portion 45 having a closed shaft support hole 45*a* is provided in a lower part of the first case 43. A transmission lever placing portion 46 is provided on the side of the projection 44*b* of the cam member placing portion 45. A worm placing portion 47 is provided on the opposite side to the transmission lever placing portion 46, and a driving motor placing portion 48 is provided above the worm placing portion 47. The placing portions 45 to 48 are formed so as to swell toward the outside; that is of the side of the first case 11A. A pair of terminal insertion holes 49 is made in the projection 44*a*, and the terminal insertion hole 49 are communicated with the terminal insertion hole 17 of the first case 11A. A shaft insertion hole 50 is provided in the center of the projection 44*b* that constitutes a portion of the transmission lever placing portion 46, and an output shaft 96 of a transmission lever 94 is disposed so as to be inserted through the shaft insertion hole 50. The shaft insertion hole 50 is a second communication hole, which is made so as to be communicated with the lever attaching portion 15A that is the first communication hole of the first case 11A. Brackets 51*a* and 51*b* are projected in the projections 44*a* and 44*b*, and the brackets 51*a* and 51*b* include screw holes that are aligned with screw tightening portions 25*a* and 25*b* of the first case 11A.

Figure 10:
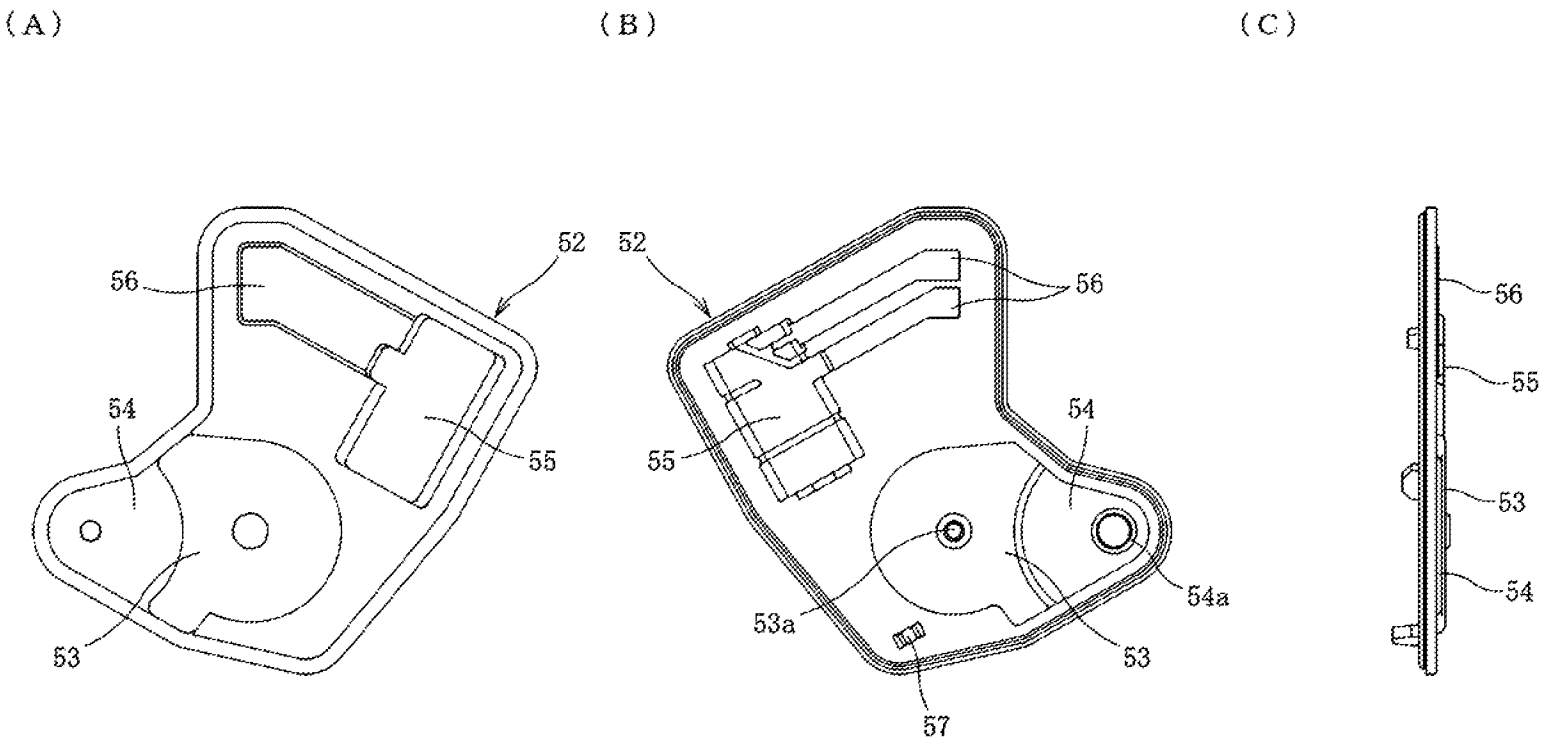
FIG. 10 shows an outer surface of a second case of the second housing in a front view illustrating a side of in (A), in a rear view illustrating a side of an inner surface in (C) and in a side view in (C)

The second case 52 is formed into the same shape as the opening of the first case 43, and the second case 52 is fixed to the first case 43 by the ultrasonic welding. As illustrated in FIGS. 10(A) to 10(C), a cam member cover 53 is provided in the second case 52, and the cam member cover 53 includes a closed shaft support hole 53*a* that is aligned with the cam member placing portion 45. A transmission lever cover 54 is provided opposite the transmission lever placing portion 46, and the transmission lever cover 54 includes a shaft support portion 54*a* whose axial center aligned with that of the shaft insertion hole 50. A driving motor cover 55 is provided opposite the driving motor placing portion 48. A wiring portion 56 is provided so as to extend from the position opposite the terminal insertion hole 49 to the driving motor cover 55. The covers 53 to 55 and the wiring portion 56 are formed so as to swell outward. A shaft support portion 57 that journals a driving shaft of a driving motor 108 is provided opposite the worm placing portion 47.

The second housing 42 having the above configuration can be attached to the second housing attaching portion 23 of the first housing 10 at user's desire. When the second housing 42 is attached to the first housing 10 for automatic operating specifications in which the first case 11A is used, the lever attaching portion 15A that is the first communication hole is aligned with the shaft insertion hole 50 that is the second communication hole, and the inside of the first housing 10 and the inside of the second housing 42 are communicated with each other. The terminal insertion holes 17 and 49 of the housings 10 and 42 are aligned and communicated with each other. However, because the lever attaching portion 15A being the hole and the terminal insertion hole 17 are not made in the first housing 10 with manual operating specifications in which the first case 11B is used, the first housing 10 is not communicated with the second housing 42 even if the second housing 42 is attached.

Figure 14:
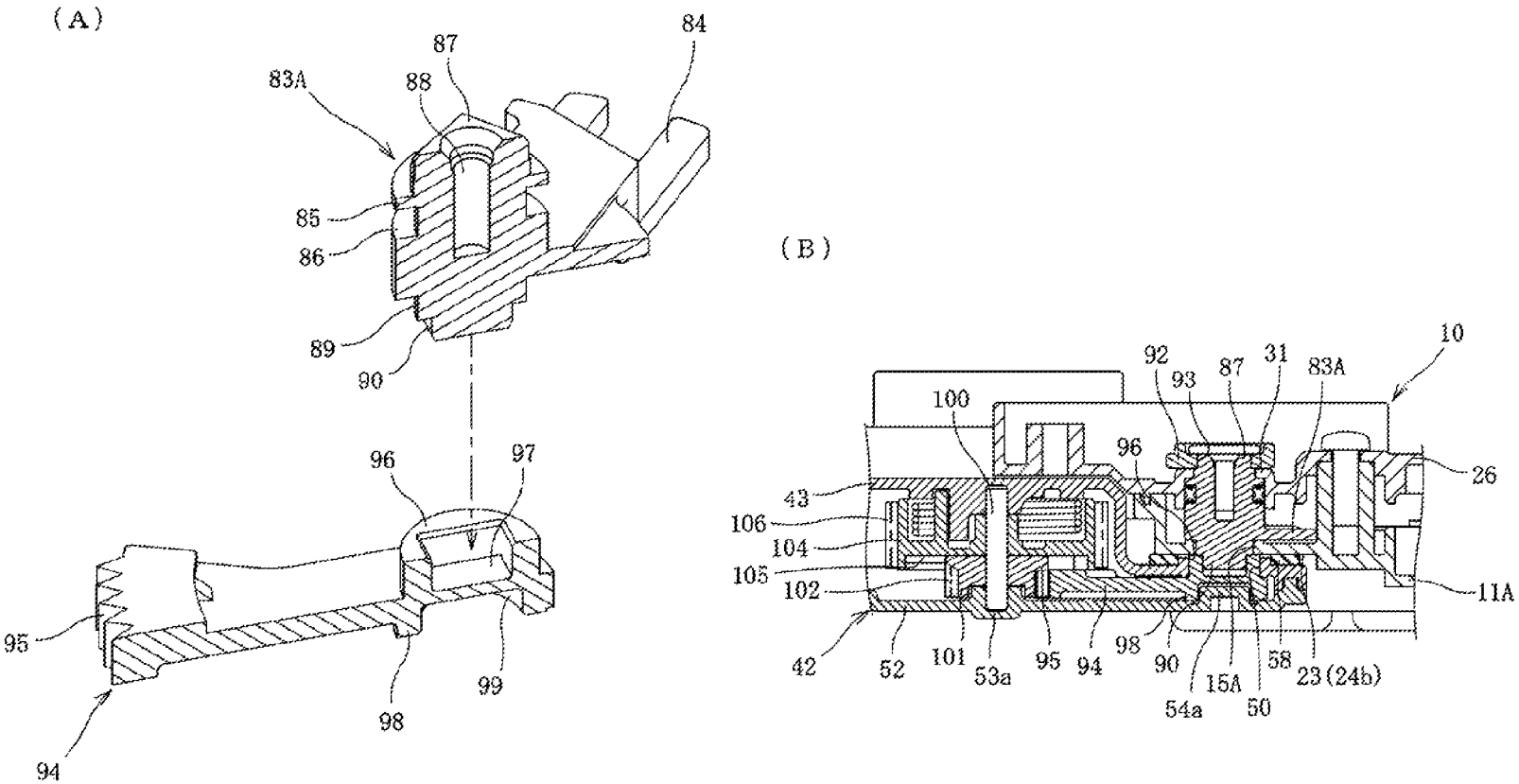
FIG. 14 shows a partially sectional perspective view illustrating a switching lever for automatic operating specifications and a transmission lever for automatic operating specifications in (A), a sectional view illustrating a main portion of the door locking apparatus with automatic operating specifications in (B)
Figure 16:
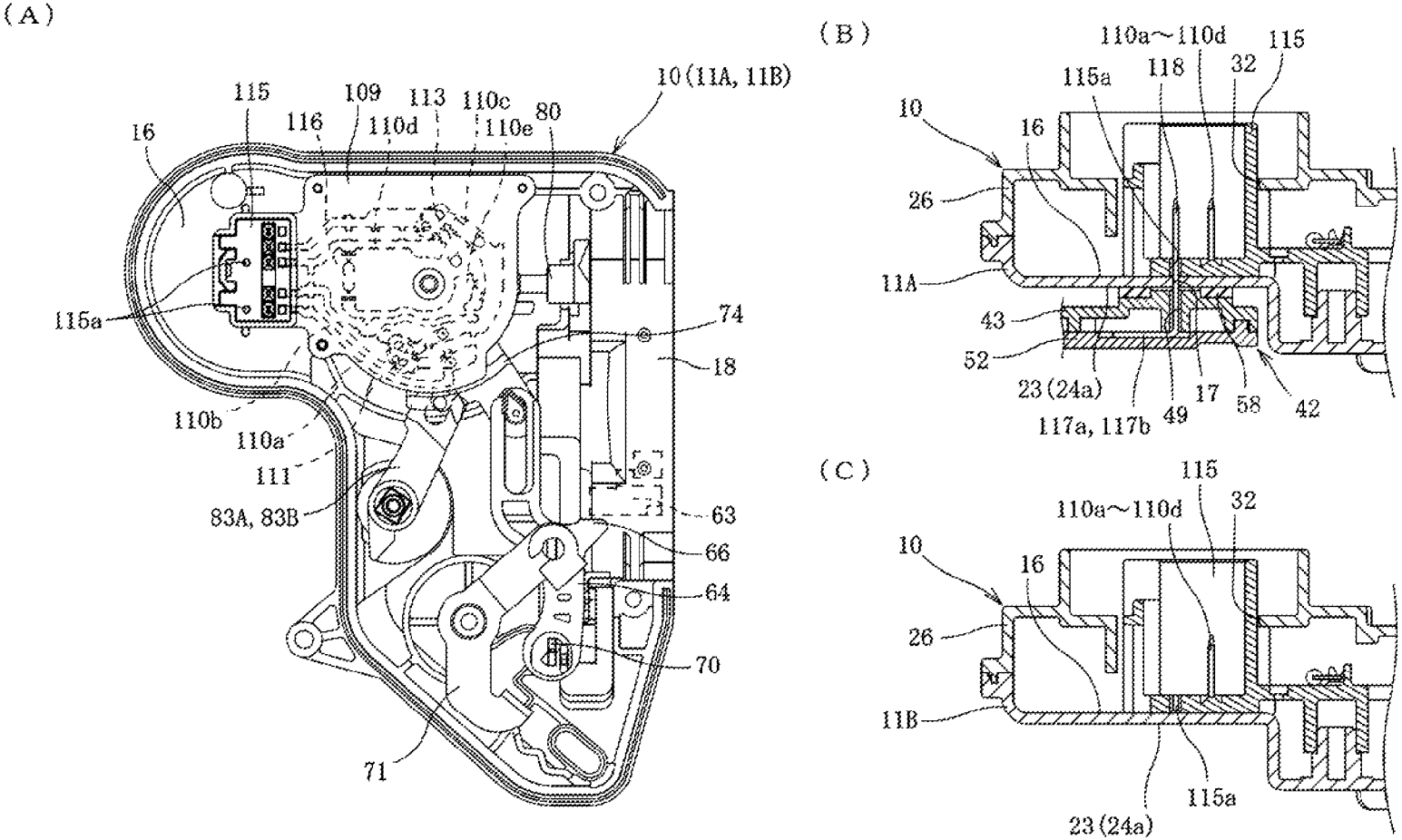
FIG. 16 shows a front view illustrating a state in which a locking state detector and a connector are provided in the first housing in (A), a sectional view illustrating the main portion of the door locking apparatus with automatic operating specifications in (B) and a sectional view illustrating the main portion of the door locking apparatus with manual operating specifications in (C).

As illustrated in FIGS. 14(B) and 16(B), in the embodiment, a waterproof sealing member 58 is disposed between the first housing 10 for automatic operating specifications in which the first case 11A is used and the second housing 42. The sealing member 58 is an annular waterproof pad that surrounds the lever attaching portion 15A, the shaft insertion hole 50, and the terminal insertion holes 17 and 49, and is pressed by the first case 11A and the first case 43 to prevent the water immersion into the first and second housings 10 and 42 through the holes.

The latch mechanism is assembled in the third case 34. As illustrated in FIGS. 8(A) and 8(B), the latch mechanism includes the fork 59 that detachably latches the striker 1 and the claw 61 that engages the fork 59 to maintain the state in which the fork 59 retains the striker 1. When the striker 1 invades into the latching groove 60 of the fork 59 by closing the door, the latch mechanism turns counterclockwise by a pressing force of the striker 1 in association with a closing force of the door as illustrated in FIGS. 5(A) and 5(B). A latching portion 62 of the claw 61 is latched in the fork 59, thereby maintaining the state in which the striker 1 is latched in the fork 59. In this state, when the manipulation receiving portion 63 of the claw 61 is actuated upward, the claw 61 turns clockwise to release the latching of the fork 59 by the claw 61. As a result, the fork 59 turns to the opening position illustrated in FIG. 5(A) by a biasing force of a spring (not illustrated), thereby releasing the latching of the striker 1.

Figure 11:
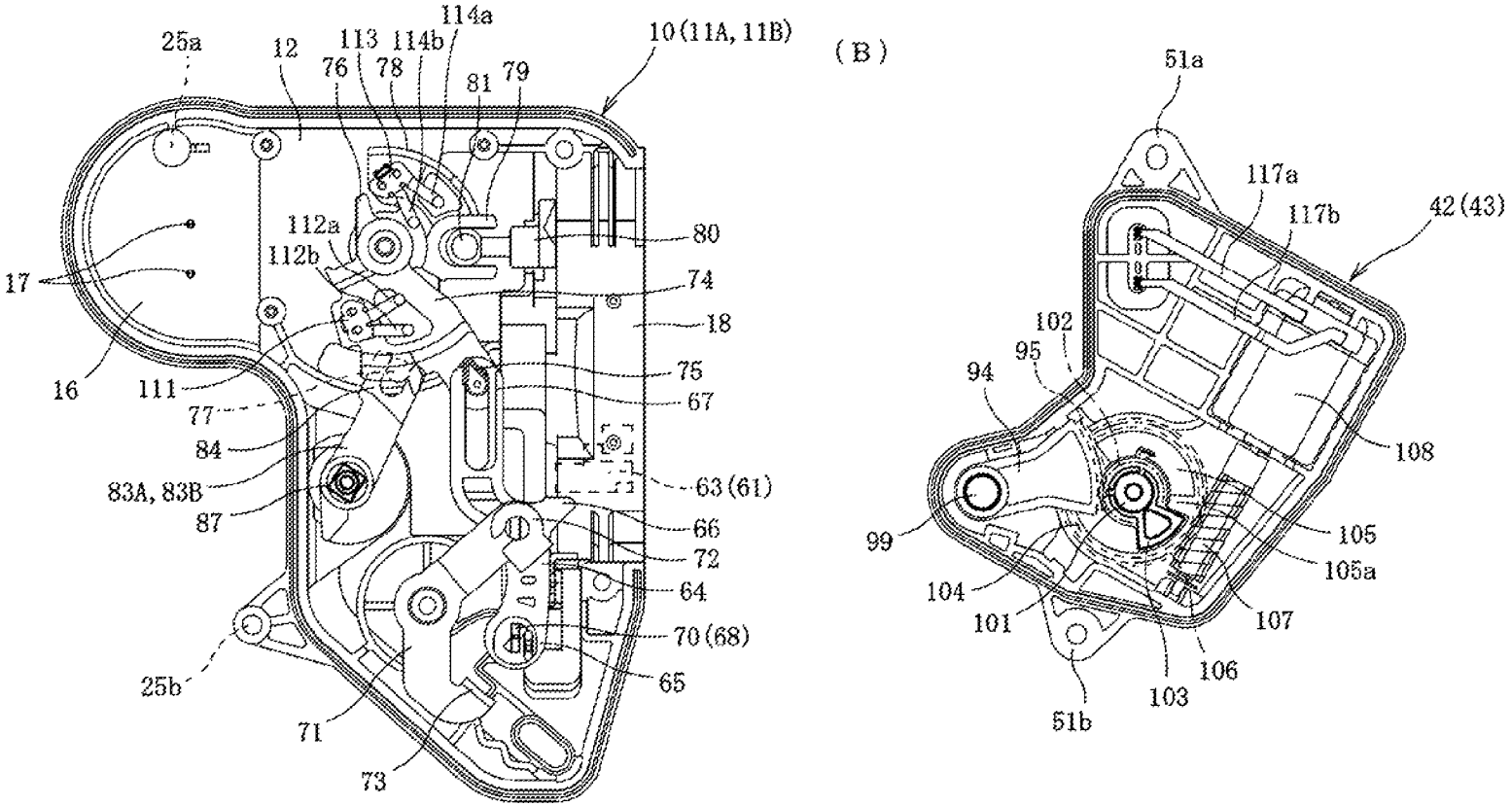
FIG. 11 shows a front view illustrating a door opening mechanism and a manual locking mechanism which are provided in the first housing in (A) and a rear view illustrating an automatic locking mechanism provided in the second housing in (B)

The door opening mechanism can be displaced between the unlocking position where the striker 1 latched in the latch mechanism can be released and the locking position where the striker 1 latched in the latch mechanism cannot be released. As illustrated in FIG. 11(A), the door opening mechanism includes a link 64 that actuates the claw 61 in a latching releasing direction and the outer lever 68 and the inner lever 71, which perform releasing actuation of latch mechanism through the link 64.

A receiving portion 65 at the lower end of the link 64 receives an actuation force of the outer lever 68 or the inner lever 71, thereby moving the link 64 upward. In the unlocking position illustrated in FIGS. 12(A) and 13(A), the substantially central manipulating portion 66 abuts on the manipulation receiving portion 63 of the claw 61 to actuate the claw 61 in the latching releasing direction. Therefore, the striker latched by the latch mechanism can be released. The upper locking plate coupling portion 67 of the link 64 is coupled to the locking plate 74, and the link 64 is moved to the unlocking position and the locking position by the turn of the locking plate 74. In the locking position illustrated in FIGS. 12(B) and 13(B), the manipulating portion 66 is separated from the Manipulation receiving portion 63 of the claw 61, and the manipulating portion 66 cannot abut on the manipulation receiving portion 63. Therefore, even if the link 64 is moved upward by the outer lever 68 or the inner lever 71, the claw 61 cannot be actuated in the latching releasing direction. Therefore, the striker 1 latched in the latch mechanism cannot be released.

The outer lever 68 is turnably attached to the second placing portion 18 so as to extend inward and outward through the first placing portion 12 of the first cases 11A and 11B. In the outer lever 68, when the outer handle (not illustrated) provided on the exterior side of the door is manipulated, an outer handle connecting portion 69 projected outward as illustrated in FIG. 4B is moved clockwise (outward). As a result, a link coupling portion 70 of the outer lever 68 located in the first placing portion 12 is moved upward to move the link 64 upward.

As illustrated in FIG. 11(A), the inner lever 71 is turnably attached to the first placing portion 12 of the first cases 11A and 11B. The inner lever 71 is coupled to the inner handle provided on the interior side of the door through a cable 119A. When the inner handle is manipulated, the inner handle coupling portion 72 projected outward from the first housing 10 is pulled leftward. As a result, the inner lever 71 turns counterclockwise, and a link actuation portion 73 at the lower end of the inner lever 71 abuts on the receiving portion 65 of the link 64 to move the link 64 upward.

In the manual locking mechanism, the link 64 is moved to the unlocking position and the locking position by the manipulations of the key cylinder for use from outside the vehicle and the locking knob for use from inside the vehicle. The manual locking mechanism includes the locking plate 74 that moves the link 64, a key manipulation force transmission mechanism that is of an outer locking system, and a knob manipulation force transmission mechanism that is of an inner locking system. The key manipulation force transmission mechanism transmits the manipulation force of the key cylinder disposed on the exterior side of the door to the locking plate 74, and includes the key switch lever 78 and the key lever 80. The knob manipulation force transmission mechanism transmits the manipulation force of the locking knob provided on the interior side of the door to the locking plate 74, and includes the two kinds of the switching levers 83A and 83B and a knob lever 92. The switching lever 83A is the automatic operating specifications, and the switching lever 83B is the manual operating specifications. In the embodiment, the locking plate 74 and the switching lever 83A also have a function of transmitting the rotational driving torque of the automatic locking mechanism to the door opening mechanism.

The locking plate 74 is turnably attached to the first placing portion 12 of the first cases 11A and 11B. The locking plate 74 turns clockwise by the key switch lever 78 or the switching levers 83A and 83B, whereby a link latching portion 75 is moved leftward to move the link 64 from the unlocking position to the locking position. The locking plate 74 turns counterclockwise, whereby the link latching portion 75 is moved rightward to move the link 64 from the locking position to the unlocking position. In the locking plate 74, the unlocking actuation of the key switch lever 78 is received by a protruding unlocking actuation receiving portion 76, and the locking actuation of the key switch lever 78 is received by the right edge part. The unlocking actuation and the locking actuation, which are performed by the switching levers 83A and 83B, are received by a switching lever latching portion 77 that is located on the opposite side to the link latching portion 75.

The key switch lever 78 is turnably attached to the first placing portion 12 of the first cases 11A and 11B so as to be coaxial with the locking plate 74. In the key switch lever 78, a key lever latching portion 79 turns clockwise by the key lever 80, thereby moving the link 64 to the locking position through the locking plate 74. The key lever latching portion 79 turns counterclockwise to move the link 64 to the unlocking position through the locking plate 74.

The key lever 80 is turnably attached to the second placing portion 18 such that a switch lever latching portion 81 at one end of the key lever 80 is located in the first placing portion 12 of the first cases 11A and 11B. In the key lever 80, the coupling lever 82 (see FIG. 1) coupled to the outside of the first housing 10 through the lever insertion hole 22 of the second placing portion 18 turns by the manipulation of the key cylinder, thereby vertically moving the switch lever latching portion 81 of the first placing portion 12. Therefore, the key switch lever 78 turns clockwise or counterclockwise.

The switching levers 83A and 83B is turnably disposed in the lever attaching portions 15A and 15B of the first placing portion 12 of the first cases 11A and 11B. The switching levers 83A and 83B are turned counterclockwise by the knob lever 92, whereby a locking plate latching portion 84 at an edge turns the locking plate 74 to the locking position. The switching levers 83A and 83B turn clockwise, whereby the locking plate latching portion 84 turns the locking plate 74 to the unlocking position.

As illustrated in FIGS. 14(A) and 14(B), the switching lever 83A for automatic operating specifications includes a shaft portion 85 that is projected upward in an end part of the locking plate latching portion 84 that extends into a plate shape. A sealing member placing portion 86 consisting of an annular groove is provided above the shaft portion 85. A knob lever coupling portion 87 having a rectangular shape in section is projected in an upper end surface of the shaft portion 85. A coupling hole 88 that extends from the upper end surface to the shaft portion 85 is made in the knob lever coupling portion 87. A shaft fitting portion 89 having a circular shape in section is projected downward in the switching lever 83A. The shaft fitting portion 89 is turnably fitted in the lever attaching portion 15(A) consisting of a hole on the side opposite the shaft portion 85. A transmission lever coupling portion 90 having a circular shape in section is projected in the lower end surface of the shaft fitting portion 89.

Figure 13:
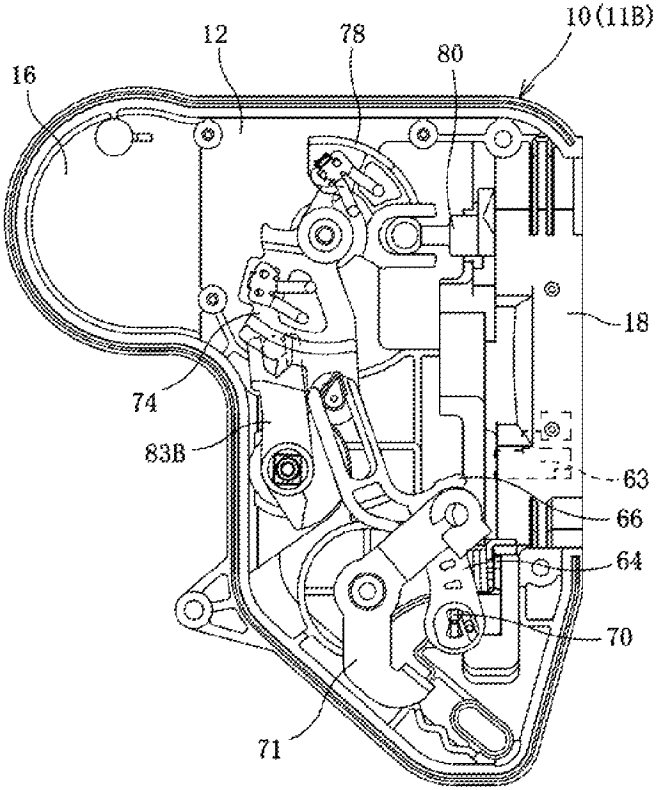
FIG. 13 shows the door locking apparatus with manual operating specifications in a front view illustrating the unlocking state in (A) and in a front view illustrating the locking state in (B)
Figure 13:
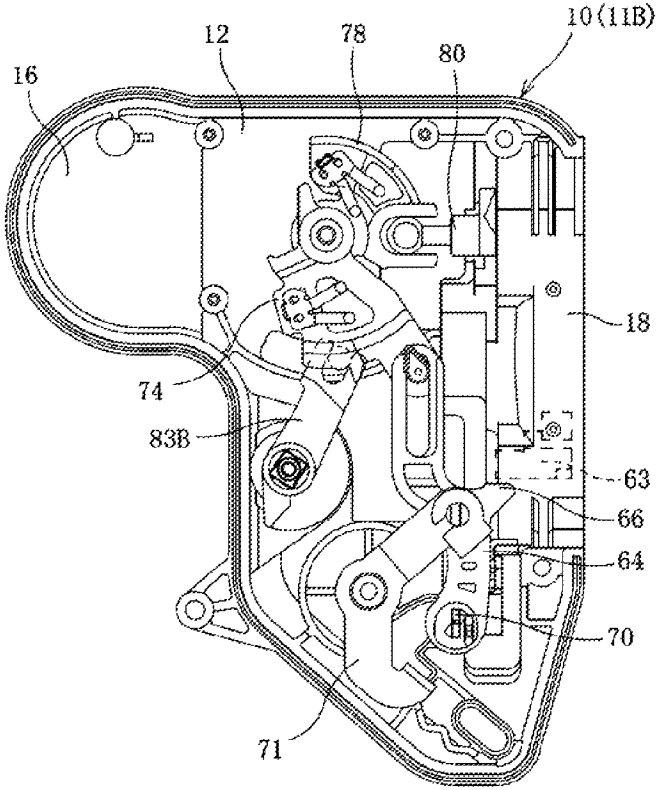
Figure 15:
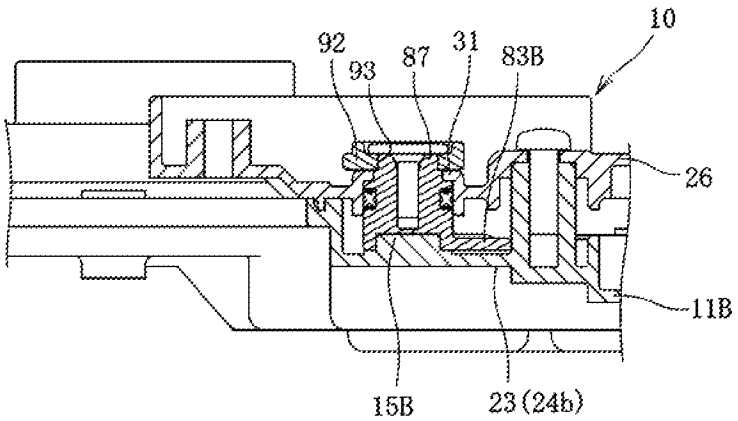
FIG. 15 shows a partially sectional perspective view illustrating switching lever for manual operating specifications in (A) and a sectional view illustrating a main portion of the door locking apparatus with manual operating specifications in (B)
Figure 15:
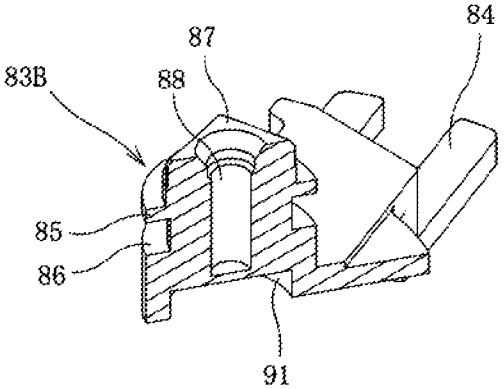

As illustrated in FIGS. 13(A) and 15(B), similarly to the switching lever 83A, the switching lever 83B for manual operating specifications includes the shaft portion 85, the sealing member placing portion 86, the knob lever coupling portion 87, and the coupling hole 88. Instead of the shaft fitting portion 89 and the transmission lever coupling portion 90, a shaft hole portion 91 is made so as to be recessed upward. The shaft hole portion 91 is turnably disposed in the lever attaching portion 15B consisting of the projection of the first case 11B.

As illustrated in FIGS. 4(A), 14(B), and 15(B), the knob lever 92 includes a switching lever coupling hole 93. The switching lever coupling hole 93 is coupled to the knob lever coupling portion 87 of the switching levers 83A and 83B while the knob lever coupling portion 87 is externally fitted in the switching lever coupling hole 93, and the knob lever coupling portion 87 is projected from the second case 26 of the first housing 10. The knob lever 92 is coupled to the locking knob for use from inside the through the cable 119B. When the locking manipulation is performed to the locking knob, the knob lever 92 rotates in the locking direction through the cable 119B to turn the switching levers 83A and 83B counterclockwise. When the unlocking manipulation is performed to the locking knob, the knob lever 92 rotates in the unlocking direction through the cable 119B to turn the switching levers 83A and 83B clockwise.

When the electric signal (electric power) is input to the automatic locking mechanism by the manipulation of the locking switch placed in the vehicle or the remote controller, the automatic locking mechanism moves the link 64 to the unlocking position or the locking position. As illustrated in FIG. 11(B), the automatic locking mechanism includes the transmission lever 94, a gear member 101, a cam member 104, a worm 107, and a driving motor 108. The rotational driving torque of the driving motor 108 is transmitted to the link 64 of the door opening mechanism through the switching lever 83A and the locking plate 74 of the manual locking mechanism.

The transmission lever 94 is turnably attached to the shaft insertion hole 50 of the first case 43 of the second housing 42. As illustrated in FIGS. 14(A) and 14(B), the transmission lever 94 includes a gear portion 95 at the leading end thereof. An output shaft 96 that is turnably fitted in the shaft insertion hole 50 is provided in the end part on the side opposite the gear portion 95, and a rectangular switching lever coupling hole 97 to which the transmission lever coupling portion 90 is coupled is provided on the end surface of the output shaft 96. A shaft fitting portion 98 similar to the output shaft 96 is provided on the side opposite the output shaft 96, and a shaft hole portion 99 that is turnably fitted in the support shaft portion 54*a* of the second case 52 is provided on the end surface of the shaft fitting portion 98. When the gear member 101 rotates, and the transmission lever 94 rotates by the engagement with the gear member 95 at the leading end and transmits the rotational driving torque to the switching lever 83A.

As illustrated in FIGS. 11(B) and 14(B), the gear member 101 is turnably disposed around a shaft member 100 that is separately disposed between the shaft support holes 45*a* and 53*a* of the second housing 42. In the outer circumferential part, the gear member 101 includes a gear portion 102 that engages the gear portion 95 of the transmission lever 94. The gear member 101 is disposed in a cam groove 105 of the cam member 104, the rotation of the cam member 104 is received by a pressing receiving portion 103 that is projected outward, and the gear member 101 turns clockwise or counterclockwise. The rotational torque is transmitted to the transmission lever 94 by the gear portion 102.

In the second housing 42, the cam member 104 is turnably disposed around the shaft member 100 that is coaxial with the gear member 101. The cam member 104 includes the cam groove 105 in which a portion of the gear member 101 is located, and the gear member 101 is turned while pressed by a pressing portion 105*a* of the cam groove 105. A worm wheel portion 106 is provided on the outer circumferential surface of the cam member 104, the rotational torque of the worm 107 is received by the worm wheel portion 106, whereby the cam member 104 rotates.

The worm 107 is disposed in the worm placing portion 47 of the second housing 42 while fixed to the driving shaft of the driving motor 108. The driving motor 108 is disposed in the driving motor placing portion 48 of the second housing 42, and the driving motor 108 can rotate normally and reversely by switching the current passing direction. The driving shaft of the driving motor 108 is journaled by the shaft support portion 57 of the second case 52.

The door locking apparatus having the above components further includes a locking state detection mechanism that detects the unlocking state or the locking state of the link 64 of the door opening mechanism. The locking state detection mechanism includes fixed contact members 110*a* to 110*c* that are placed in a substrate 109 illustrated in FIG. 16(A) and a movable contact member 111 that is disposed on the locking plate 74 illustrated in FIG. 11(A). When the link 64 is located in the unlocking position, a contact portion 112*a* of the movable contact member 111 of the locking plate 74 is short-circuited to the fixed contact member 110*c*, and a contact portion 112*b* is short-circuited to the fixed contact member 110*a*, which allows the unlocking state to be detected. When the link 64 is located in the locking position, the contact portion 112*a* of the movable contact member 111 is short-circuited to the fixed contact member 110*c*, and the contact portion 112*b* is short-circuited to the fixed contact member 110*b*, which allows the locking state to be detected.

A key manipulation detection mechanism is mounted on the door locking apparatus disposed in the door on the side of the driver's seat. The key manipulation detection mechanism detects that the unlocking manipulation and the locking manipulation are performed by inserting the key in the key cylinder. The key manipulation detection mechanism includes fixed contact members 110*c* to 110*e* that are placed on the substrate 109 illustrated in FIG. 16(A) and a movable contact member 113 that, is disposed on the key switch lever 78 illustrated in FIG. 11(A). When the key cylinder is not manipulated, a contact portion 114*a* of the movable contact member 113 of the key switch lever 78 is short-circuited to the fixed contact member 110*c*, and a contact portion 114*b* is insulated, which allows the non-manipulation state to be detected. When the unlocking manipulation of the key cylinder is performed, the contact portion 114*a* is short-circuited to the fixed contact member 110*c*, and the contact portion 114*b* is short-circuited to the fixed contact member 110*d*, which allows the unlocking manipulation to be detected. When the locking manipulation of the key cylinder is performed, the contact portion 114*a* is short-circuited to the fixed contact member 110*c*, and the contact portion 114*b* is short-circuited to the fixed contact member 110*e*, which allows the locking manipulation to be detected.

A connector 115 is disposed on the substrate 109 such that a signal line, a power line and the like are electrically connected to input and output the electric power and the electric signal. The connector 115 is formed into a substantially rectangular pipe shape having a bottom. The connector 115 is disposed in the connector placing portion 16 of the first cases 11A and 11B, and the connection opening of the connector 115 is externally exposed from the connector connecting port 32 of the second case 26. In a bottom of the connector 115, two terminal insertion holes 115*a* are made in the positions corresponding to the terminal insertion holes 17 of the first case 11A. In the fixed contact members 110*a* to 110*e*, connection terminal portions located at ends of the fixed contact member 110*a* to 110*d* are disposed in the connector 115. The fixed contact member 110*e* is electrically connected to the fixed contact member 110*d* through a resistor 116. A reference current is passed through the fixed contact member 110*c*. Therefore, the unlocking detection state is output from the fixed contact member 110*a*. The locking detection state is output from the fixed contact member 110*b*. The unlocking manipulation state and the locking manipulation state are output from the fixed contact member 110*d*. Then the manipulation state can be determined by a difference in output voltage of the resistor 116.

In the first housing 10 for automatic operating specifications, the electric power is supplied to the driving motor 108 of the automatic locking mechanism through the electrically-connected connector 115. A pair of terminals 117*a* and 117*b* is disposed in the first case 43 of the second housing 42 in order to supply the electric power to the driving motor 108. The terminals 117*a* and 117*b* are constructed by a metallic plate having conductivity, and one end of each of the terminals 117*a* and 117*b* is connected to the driving motor 108. The other end of each of the terminals 117*a* and 117*b* constitutes a connection terminal 118 for connecting the connector, and the connection terminal 118 is projected toward the outside of the second housing 42 through the terminal insertion hole 49.

When the second housing 42 is disposed on the second housing attaching portion 23 of the first housing 10 for automatic operating specifications, the connection terminal 118 projected from the second housing 42 is aligned with the terminal insertion hole 17 of the first case 11A. The output shaft 96 of the transmission lever 94 exposed from the shaft, insertion hole 50 of the second housing 42 is aligned with the transmission lever coupling portion 90 of the switching lever 83A projected from the lever attaching portion 15A of the first case 11A. When the second housing 42 is attached to the first housing 10 by a screw, the switching lever 83A and the transmission lever 94 are coupled so as to turn integrally as illustrated in FIG. 14(A), and the connection terminal 118 is disposed in the connector 115 through the terminal insertion hole 17 and a terminal through-hole 115*a* as illustrated in FIG. 16(B).

Figure 12:
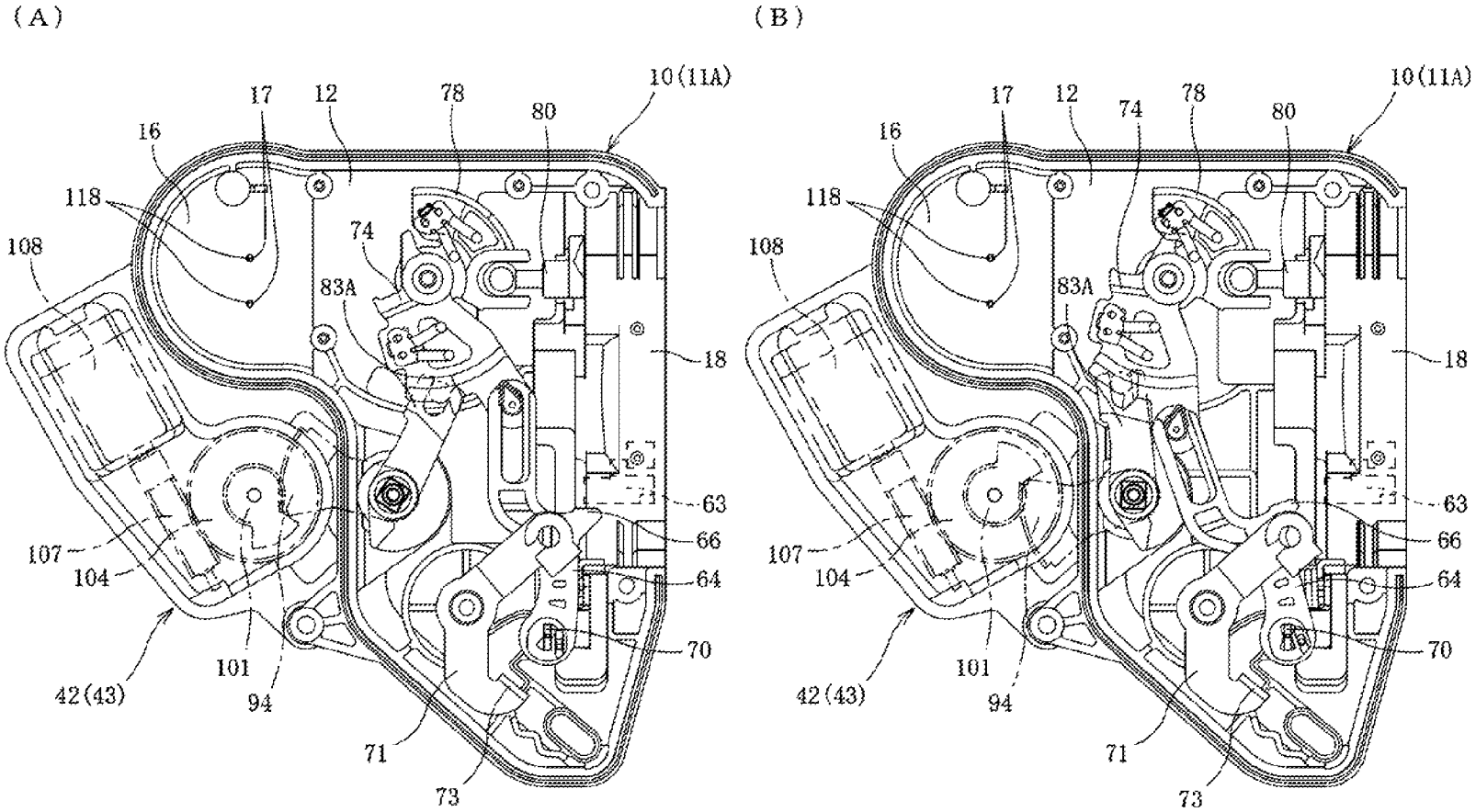
FIG. 12 shows the door locking apparatus with automatic operating specifications in a front view illustrating an unlocking state in (A) and in a front view illustrating an locking state in (B)

In the door locking apparatus with automatic operating specifications, when the unlocking signal (current in the unlocking direction) is input from an electric control portion (ECU) of the vehicle, the driving motor 108 rotates normally, and the link 64 can be moved to the unlocking position illustrated in FIG. 12(A) through the worm 107, the cam member 104, the gear member 101, the transmission lever 94, the switching lever 83A, and the locking plate 74. When the locking signal (current in the locking direction) is input from the ECU, the driving motor 108 rotates reversely, and the link 64 can be moved to the locking position illustrated in FIG. 12(B) through the worm 107, the cam member 104, the gear member 101, the transmission lever 94, the switching lever 83A, and the locking plate 74.

When the unlocking manipulation is performed to the locking knob in the vehicle, the link 64 can be moved to the unlocking position illustrated in FIG. 12(A) through, the knob lever 92, the switching lever 83A, and the locking plate 74. When the locking manipulation is performed to the locking knob, the link 64 can be moved to the locking position illustrated in FIG. 12(B) through the knob lever 92, the switching lever 83A, and the locking plate 74.

When the unlocking manipulation is performed to the key cylinder outside the vehicle, the link 64 can be moved to the unlocking position illustrated in FIG. 12(A) through the key lever 80, the key switch lever 78, and the locking plate 74. When the locking manipulation is performed to the key cylinder, the link 64 can be moved to the locking position illustrated in FIG. 12(B) through the key lever 80, the key switch lever 78, and the locking plate 74.

In the door locking apparatus with manual operating specifications, when the unlocking manipulation is performed to the locking knob in the vehicle, the link 64 can be moved to the unlocking position illustrated in FIG. 13(A) through the knob lever 92, the switching lever 83B, and the locking plate 74. When the locking manipulation is performed to the locking knob, the link 64 can be moved to the locking position illustrated in FIG. 13(B) through the knob lever 92, the switching lever 83B, and the Locking plate 74.

When the unlocking manipulation is performed to the key cylinder outside the vehicle, the link 64 can be moved to the unlocking position illustrated in FIG. 13(A) through the key lever 80, the key switch lever 78, and the locking plate 74. When the locking manipulation is performed to the key cylinder, the link 64 can be moved to the locking position illustrated in FIG. 13(B) through the key lever 80, the key switch lever 78, and the locking plate 74.

In both the door locking apparatuses with automatic operating specifications and with manual operating specifications, when the inner handle is manipulated in the unlocking state, the link 64 is moved upward through the inner lever 71, and the striker 1 latched in the fork 59 can be released by turning the claw 61. When the outer handle is manipulated, the link 64 is moved upward through the outer lever 68, and similarly the latching of the striker 1 can be released.

In the locking state, even if the inner handle is manipulated to move the link 64 upward through the inner lever 71, because the link 64 cannot abut on the claw 61, the striker 1 latched in the fork 59 cannot be released. Even if the outer handle is manipulated to move the link 64 upward through the outer lever 68, similarly the latching of the striker 1 cannot be released.

Thus, in the door locking apparatus of the invention, the door opening mechanism and the manual locking mechanism are accommodated in the first housing 10, and the automatic locking mechanism is accommodated in the second housing 42. In a use with the automatic operating specifications, the second housing 42 on which the automatic locking mechanism is mounted is attached to the first housing 10 to form the door locking apparatus. In a use with the manual operating specifications, the door locking apparatus includes only the first housing 10 without attaching the second housing 42.

In the door locking apparatus with automatic operating specifications, the automatic locking mechanism is disposed in the second housing 42 that is different from the first housing 10 in which the door opening mechanism is disposed. The rotational driving torque of the automatic locking mechanism can be transmitted to the door opening mechanism through the lever attaching portion 15A that is the communication hole of each of the housings 10 and 42 and the shaft insertion hole 50. In the door locking apparatus with automatic operating specifications, the door opening mechanism and the manual locking mechanism are accommodated in the closed first housing 10, and the automatic locking mechanism is accommodated in the closed second housing 42. Therefore, the waterproof property and the burglar-proof property can be maintained.

The switching lever 83A constituting the manual locking mechanism is disposed on the lever attaching portion 15A of the first housing 10, and the output shaft 96 that outputs the rotational driving torque of the automatic locking mechanism is disposed in, the shaft insertion hole 50 of the second housing 42, whereby the automatic locking mechanism actuates the door opening mechanism through the manual locking mechanism. Therefore, the automatic locking mechanism accommodated in the second housing 42 can easily be coupled. The manual locking mechanism is also used to transmit the rotational driving torque of the automatic locking mechanism to the door opening mechanism, so that the configuration of components disposed in the first housing 10 can be simplified. The sealing member 58 is disposed between the first and second housings 10 and 42 so as to surround the lever attaching portion 15A and the shaft insertion hole 50, so that the water immersion from the holes 15A and 50 can be prevented to ensure the waterproof property.

On the other hand, in the door locking apparatus with manual operating specifications, the door opening mechanism and the manual locking mechanism are disposed in the first housing 10, so that the driving force of the manual locking mechanism can securely be transmitted to the door opening mechanism. Because the necessity to provide the space in which the automatic locking mechanism is accommodated is eliminated in the first housing 10, the miniaturization and the weight reduction can be implemented. In the door locking apparatus with manual operating specifications, the door opening mechanism and the manual locking mechanism are accommodated in the closed first housing 10, so that the waterproof property and the burglar-proof property can be maintained.

The first housing 10 to which the second housing 42 is not attached includes the lever attaching portion 15B in which the communication hole coupled to the automatic locking mechanism of the second housing 42 is closed, so that the water immersion into the first housing 10 can securely be prevented.

In the door locking apparatus of the present embodiment, the locking state detector that detects the unlocking state or the locking state of the door opening mechanism to output the detection state and the electrically-connecting connector 115 are disposed in the first housing 10, the connector placing portion 16 of the first housing 10, in which the connector 115 is disposed, is provided so as to be located inside the second housing attaching portion 23, and the terminal insertion hole 17 is made in order to supply the electric power to the automatic locking mechanism. Therefore, in the case of each of the manual operating specifications and the automatic operating specifications, the same connector 115 can be used, and the work for connecting an external connector can be performed at one point.

The door locking apparatus of the invention is not limited to the embodiment, but various changes can be made.

That is, the invention includes any configuration, in which the necessary door opening mechanism and the necessary manual locking mechanism are disposed in the first housing 10, the automatic locking mechanism, which is not always necessary for the vehicle, is disposed in the second housing 42, and the second housing attaching portion 23 to which the second housing 42 can be attached is provided in the first housing 10.

In the embodiment, the manual locking mechanism is used in order to transmit the rotational driving torque of the automatic locking mechanism to the door opening mechanism. The invention is not limited to the configuration of the embodiment. For example, the link 64 may directly be movably coupled to the unlocking position or the locking position.

The configurations of the latch mechanism, the door opening mechanism, the manual locking mechanism, and the automatic locking mechanism can be changed as needed basis.

What is claimed is:

1. A door locking apparatus comprising:

a latch mechanism that can latch and release a striker;

a door opening mechanism that can switch between an unlocking position where the striker latched by the latch mechanism can be released and a locking position where the striker latched by the latch mechanism cannot be released, wherein the door opening mechanism can be operated by a manipulation of an inner handle or an outer handle for opening a door;

a manual locking mechanism that moves the door opening mechanism to the unlocking position or the locking position by a manipulation of a locking knob for use from inside a vehicle or a key cylinder for use from outside the vehicle;

an automatic locking mechanism that moves the door opening mechanism to the unlocking position or the locking position based on an input of an electric signal;

a first housing in which at least the door opening mechanism and the manual locking mechanism are disposed; and a second housing in which the automatic locking mechanism is disposed; and a second housing attaching portion to which the second housing is attached is provided on an outside of the first housing, wherein first and second communication holes through which a rotational driving torque of the automatic locking mechanism is transmitted to the door opening mechanism are made in the first and second housings so as to be communicated with each other; and a locking state detector that detects an unlocking state or a locking state of the door opening mechanism to output the detection state as an electric signal and a connector that externally outputs the electric signal from the locking state detector, wherein the locking state detector and the connector are disposed in the first housing, wherein a connector placing portion of the first housing, in which the connector is disposed, is provided so as to be located inside the second housing attaching portion, and a terminal insertion hole through which a connection terminal is disposed is made in the connector placing portion in order to supply an electric power to the automatic locking mechanism.

2. The door locking apparatus according to claim 1, wherein a switching lever constituting the manual locking mechanism is turnably disposed in the first communication hole of the first housing, an output shaft that outputs the rotational driving torque of the automatic locking mechanism is disposed in the second communication hole of the second housing, the switching lever and the output shaft are coupled through the first and second communication holes so as not to be able to relatively turn, and the automatic locking mechanism moves the door opening mechanism to the unlocking position and the locking position through the manual locking mechanism.

3. The door locking apparatus according to claim 1, wherein an annular sealing member is disposed between the first and second housings so as to surround the first and second communication holes.

4. A door locking apparatus comprising:

a latch mechanism that can latch and release a striker;

a door opening mechanism that can switch between an unlocking position where the striker latched by the latch mechanism can be released and a locking position where the striker latched by the latch mechanism cannot be released, wherein the door opening mechanism can be operated by a manipulation of an inner handle or an outer handle for opening a door; and a manual locking mechanism that moves the door opening mechanism to the unlocking position or the locking position by a manipulation of a locking knob for use from inside a vehicle or a key cylinder for use from outside the vehicle;

a first housing in which at least the door opening mechanism and the manual locking mechanism are disposed;

a second housing attaching portion to which a second housing can be attached is provided in the first housing;

an automatic locking mechanism that moves the door opening mechanism to the unlocking position or the locking position based on an input of an electric signal disposed in the second housing; and a locking state detector that detects an unlocking state or a locking state of the door opening mechanism to output the detection state as an electric signal and a connector that externally outputs the electric signal from the locking state detector, wherein the locking state detector and the connector are disposed in the first housing, wherein a connector placing portion of the first housing, in which the connector is disposed, is provided so as to be located inside the second housing attaching portion, and a terminal insertion hole through which a connection terminal is disposed is made in the connector placing portion in order to supply an electric power to the automatic locking mechanism.

5. The door locking apparatus according to claim 4, wherein a communication hole through which a rotational driving torque of the automatic locking mechanism disposed in the second housing is transmitted to the door opening mechanism is closed in the first housing to which the second housing is not attached.

* * * * *